US006657127B2

(12) United States Patent
Saito

(10) Patent No.: US 6,657,127 B2
(45) Date of Patent: Dec. 2, 2003

(54) TERMINAL, STRUCTURE OF CONNECTING TERMINAL AND WIRE TOGETHER, AND METHOD OF PRODUCING TERMINAL

(75) Inventor: Yasushi Saito, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/093,608

(22) Filed: Mar. 11, 2002

(65) Prior Publication Data

US 2002/0153158 A1 Oct. 24, 2002

(30) Foreign Application Priority Data

Mar. 12, 2001 (JP) ..... P 2001-069116
Feb. 27, 2002 (JP) ..... P 2002-050748

(51) Int. Cl.[7] ..... H01R 4/24
(52) U.S. Cl. ..... 174/84 C; 439/397
(58) Field of Search ..... 174/74 R, 78, 174/84 C; 439/424, 882, 877, 881, 397, 399

(56) References Cited

U.S. PATENT DOCUMENTS 3,612,747 A * 10/1971 Shlesinger, Jr. ..... 174/84 C
3,752,901 A * 8/1973 Kuo ..... 174/84 C
3,758,703 A * 9/1973 Golden et al. ..... 174/84 C
3,812,448 A * 5/1974 Haitmanek ..... 439/421
3,902,004 A * 8/1975 Harding et al. ..... 174/84 C
3,963,857 A * 6/1976 Reynolds et al. ..... 174/84 C
3,993,393 A 11/1976 Worth
4,148,540 A * 4/1979 Hayes ..... 439/425
5,417,583 A 5/1995 Ishizaki et al.
5,879,183 A * 3/1999 Okabe ..... 439/397
6,273,745 B1 8/2001 Yeh
6,309,241 B2 10/2001 Nagai
2001/0014553 A1 8/2001 Nagai
2001/0016447 A1 8/2001 Hatagishi et al.

FOREIGN PATENT DOCUMENTS

GB 2 077 049 * 12/1981
GB 2 080 638 * 2/1982

* cited by examiner

*Primary Examiner*—Chau N. Nguyen
(74) *Attorney, Agent, or Firm*—Oliff & Berridge, PLC

(57) ABSTRACT

A pin is formed on a bottom wall of a terminal, and pierces the wire, thereby connecting the terminal and the wire together. Further, a piercing terminal is connected to a wire including a conductor, including a plurality of wire elements twisted together into a bundle, and an insulating covering material covering an outer periphery of the conductor. Piercing portions, which pierces the insulating covering material of the wire to contact the conductor within the wire, is formed upright on a bottom plate of a wire connection portion of a generally U-shaped cross-section for receiving an end portion of the wire. Each of the piercing portions is formed by stamping a relevant portion out of a side plate of the wire connection portion and by raising this stamped-out portion.

4 Claims, 21 Drawing Sheets

TERMINAL, STRUCTURE OF CONNECTING TERMINAL AND WIRE TOGETHER, AND METHOD OF PRODUCING TERMINAL

BACKGROUND OF THE INVENTION

This invention relates to a terminal, to which a wire can be connected with a simple processing without the need for removing a sheath of the wire, a structure of connecting the terminal and the wire together, and a terminal producing method.

Further, this invention relates to a piercing terminal for piercing a wire to be connected thereto, and more particularly to a piercing terminal for electrical connection to a wire having a conductor including a plurality of wire elements twisted together into a bundle.

In wire harnesses for an automobile or the like, press-contacting terminals have heretofore been used as terminals to which a wire can be connected with a simple processing without the need for removing a sheath of the wire.

FIG. 22 shows one example of conventional press-contacting terminals and this press-contacting terminal 1 includes a fitting portion 1*a* for a mating terminal, and a wire connection portion continuous with this fitting portion. In this wire connection portion, press-contacting blades 1*e* are stamped out of opposite side walls 1*c*, extending upwardly respectively from opposite side edges of a bottom wall 1*b*, and are bent inwardly, and a slot 1*d* is formed between opposed inner edges of each pair of the press-contacting blades, and in the illustrated example, the two (front and rear) pairs of press-contacting blades le are formed. As shown in FIG. 23, the opposed press-contacting blades le of the press-contacting terminal 1 cut a sheath 3*a* of a wire 3, and are press-contacted with a conductor 3*b* within the wire in a gripping manner, thus connecting the terminal 1 to the wire 3.

However, in the conventional press-contacting terminal, the press-contacting blades are contacted with the conductor within the wire in gripping relation thereto, and therefore in the case where the wire is thin (that is, the number of wire elements, forming the conductor within the wire, is small, and each wire element is thin), the wire elements are severed by the contact pressure (the load of contact of the press-contacting blades with the conductor), so that the conductor is cut, and in the case where the wire is thick (that is, the number of the wire elements is large), the contact pressure concentrates on the outer wire elements to cut these outer wire elements, so that the pressure of contact of the press-contacting blades decreases, and therefore the contact of the press-contacting blades with the conductor becomes unstable, thus inviting a problem that the contact reliability is lowered.

SUMMARY OF THE INVENTION

This invention is made in order to solve the above problems, and an object of the invention is to provide a terminal, to which a wire can be connected with a simple processing and which is excellent in contact reliability, and also to provide a method of producing this terminal.

According to the invention of aspect 10, there is provided a terminal characterized in that a pin, which can pierce a sheath of a wire to contact a conductor within the wire, is formed on a bottom wall of the terminal.

In this invention, the pin, formed on the bottom wall, is caused to pierce the wire, thereby connecting the terminal to the wire, and therefore the cutting of wire elements is less liable to occur as compared with the conventional press-contacting terminal which grips the conductor by the press-contacting blades, and therefore the incomplete contact, caused by the cutting of the wire elements when the wire is thin or thick, can be reduced. And besides, the terminal and the wire can be positively connected together with a simple processing without the need for removing the sheath of the wire.

The invention of aspect 2 is directed to the terminal according to aspect 1, characterized in that side walls are formed on opposite edges of the bottom wall, respectively.

In this invention, the wire connection processing can be effected merely by inserting the wire between the opposite side walls of the terminal without the need for removing the sheath, and the connection processing can be effected utilizing facilities similar to those for the conventional press-contacting terminal. And besides, after the wire is connected, a load is applied to the wire from the opposite side walls to compress the wire, so that the pin contacts the conductor at the proper contact pressure, thereby preventing the wire from being disengaged from the pin.

The invention of aspect 3 is directed to the terminal according to aspect 2, characterized in that a plate, which can be bent to cover the wire, is formed on an upper edge of the side wall.

In this invention, the plate, formed on the upper edge of the side wall, is bent to cover the upper side of the wire, thereby positively preventing the wire from disengagement from the pin.

The invention of aspect 4 is directed to the terminal according to aspect 3, characterized in that a hole for passing the pin therethrough is formed through the plate.

In this invention, the plate is bent to cover the upper side of the wire, and further the distal end portion of the pin is passed through the hole, and by doing so, the wire can be more positively prevented from disengagement from the pin.

The invention of aspect 5 is directed to the terminal according to any one of aspects 2 to 4, characterized in that the side walls or the plates are spread out upwardly to form an opening between distal ends thereof.

In this invention, the upwardly spread-out side walls or the upwardly spread-out plates serve as a receiving port for receiving the wire, and prevent the misregistration of the wire at the time of connecting the wire, and therefore the wire can be smoothly inserted between the side walls.

The invention of aspect 6 is directed to the terminal according to any one of aspects 1 to 5, characterized in that a plurality of pins are formed on the bottom wall.

In this invention, the plurality of pins are formed on the bottom wall, and therefore the area of contact between the terminal and the wire increases, thereby enhancing the contact reliability, and besides the wire is prevented from disengagement from the pins.

According to the invention of aspect 7, there is provided a structure of connecting a terminal and a wire together, characterized in that a pin is formed on a bottom wall of the terminal, and the pin pierces a sheath of the wire to contact a conductor within the wire, and a distal end portion of the pin is bent.

In this invention, the wire is fixed by bending the distal end portion of the pin, and therefore the wire is positively prevented from disengagement from the pin.

According to the invention of aspect 8, there is provided a method of producing a terminal, characterized in that a pin, which can pierce a sheath of a wire to contact a conductor within the wire, is formed on a bottom wall of the terminal, and the pin, which is separate from a base material of the terminal, is joined to the base material of the terminal.

In this invention, the pin is joined to the base material of the terminal, for example, by laser welding or the like, and therefore the pin, made of a material having desired strength, electrical resistance and so on, can be formed in a desired position on the bottom wall, and the terminal of high quality can be produced.

According to the invention of aspect 9, there is provided a method of producing a terminal, characterized in that a pin, which can pierce a sheath of a wire to contact a conductor within the wire, is formed on a bottom wall of the terminal, and the pin is formed integrally with the terminal by raising a stamped-out portion of a base material of the terminal.

In this invention, the pin is formed by stamping the relevant portion out of the base material of the terminal and then by raising it, and therefore the pin can be formed by the method similar to a method of forming a press-contacting blade of a conventional press-contacting terminal, and the facilities for producing the conventional press-contacting terminals can be utilized, and therefore the terminals can be produced at low costs.

Further, it is another object of this invention to provide a piercing terminal of high connection reliability, in which in the processing of an end portion of a wire, having a conductor including a plurality of wire elements twisted together into a bundle, the cutting of the wire elements, forming the conductor, is avoided, and besides this piercing terminal can be used also for a wire of a small diameter.

The above object is achieved by a piercing terminal of the invention (as defined in aspect 10) for connection to an end portion of a wire including a conductor, including a plurality of wire elements twisted together into a bundle, and an insulating covering material covering an outer periphery of the conductor; characterized in that a wire connection portion of a generally U-shaped cross-section for receiving the end portion of the wire is formed by an electrically-conductive sheet; and a piercing portion, which can pierce the insulating covering material of the wire to contact the conductor within the wire, is formed upright on a bottom plate of the wire connection portion, and the piercing portion is formed by stamping a relevant portion out of at least one of left and right side plates of the wire connection portion and by raising the stamped-out portion.

In this piercing terminal, the piercing portion, which can pierce the insulating covering material of the wire to contact the conductor within the wire, is formed upright on the bottom plate of the wire connection portion, and the piercing portion is formed by stamping the relevant portion out of the side plate of the wire connection portion and by raising the stamped-out portion. With this construction, even in the case where the wire connection portion is narrowed so as to receive the wire of a small diameter, the piercing portions can be formed upright on the bottom plate while securing the mechanical strength of the wire connection portion against an external force such as a bending force.

The piercing portion is stamped out of the side plate, and is raised to be formed on the bottom plate, and with this construction the degree of freedom of the design (such as a configuration) of the upstanding piercing portion becomes high. In the construction of the invention, the piercing portion of any of various configurations can be stamped out of the side plate, and can be raised to be formed upright on the bottom plate. And besides, as compared with the type of terminals in which the piercing portion is stamped out of the bottom plate, and is raised, the length of the wire connection portion can be made shorter, so that the terminal can be shortened.

There can be provided such a construction as defined in aspect 11, in which a plurality of the piercing portions are formed upright on the bottom plate, and are arranged in a row in a direction of a length of the wire, and the adjacent piercing portions are stamped out of the different (left and right) side plates, respectively, and are raised. With this construction, even in the case where the plurality of piercing portions are formed upright on the bottom plate so as to increase the areas of contact with the wire, depending on the specification of connection to the wire, the left and right side plates will not much differ in mechanical strength from each other, and therefore will be generally balanced in mechanical strength with each other, since the piercing portions are stamped alternately out of the left and right side plates, and are raised. Therefore, the plurality of upstanding piercing portions can be formed without any problem while securing the sufficient strength of the wire connection portion, and the areas of contact thereof with the conductor of the wire can be increased.

There can be provided such a construction as defined in aspect 12, in which the piercing portion is generally in the form of a flat plate, and is disposed parallel to the direction of the length of the wire. With this construction, when the piercing portion is caused to pierce the wire, the area of contact thereof with the conductor of the wire can be increased, thereby enhancing the connection reliability.

There can be provided such a construction as defined in aspect 13, in which the piercing portion generally in the form of the flat plate is formed on the bottom wall to be a mountain-like shape. With this construction, the piercing portion is wider at its foot portion (serving as its proximal end portion) than at its apex portion, and therefore the upstanding strength is sufficiently high that the piercing portion will not be brought down upon piercing into the wire. Namely, the piercing portion can pierce the wire, and besides the sufficient strength of the piercing portion, extending upright from the bottom plate, can be secured.

There can be provided such a construction as defined in aspect 14, in which the wire can be received and held between the left and right side plates in a compressed manner. With this construction, the pressure of contact between the piercing portion and the conductor (that is, the load of contact with the conductor) after the piercing operation can be increased, thereby enhancing the connection reliability.

BRIEF DESCRIPTION OF THE DRAWINGS

FIG. 2 shows the terminal of the invention, and

FIG. 4 shows a terminal having a plate formed on an upper edge of a side wall.

FIG. 5 shows a terminal having plates formed respectively on upper edges of opposite side walls.

FIG. 7A is a cross-sectional view before connecting the wire, and FIG. 7B is a cross-sectional view after connecting the wire.

FIG. 8 shows the process of fixing the wire to the terminal by bending the pin.

FIG. 11 shows terminals in which two pins are formed, and are spaced from each other in a direction parallel to side walls.

FIG. 12 shows a terminal in which two pins are formed, and are spaced from each other in a direction parallel to side walls.

FIG. 13 shows terminals in which two pins are formed, and are spaced from each other in a direction perpendicular to side walls.

FIG. 14 is a terminal in which two pins are formed, and are spaced from each other in a direction perpendicular to side walls.

FIG. 15 shows terminals in which two pins are formed, and are spaced from each other in a direction oblique relative to side walls.

FIG. 16 shows a terminal in which two terminals are arranged in a direction oblique relative to side walls.

FIG. 17 show a terminal in which four pins are formed on a bottom wall, and

FIG. 18 show a terminal in which four pins are formed on a bottom wall, and

FIG. 19 show a terminal in which four pins are formed on a bottom wall, and

FIG. 20 show a terminal in which four pins are formed on a bottom wall, and

FIG. 22 shows a conventional press-contacting terminal, and

DETAILED DESCRIPTION OF THE PREFERRED EMBODIMENTS

A preferred embodiment of the present invention will now be described in detail with reference to the drawings.

Figure 1:
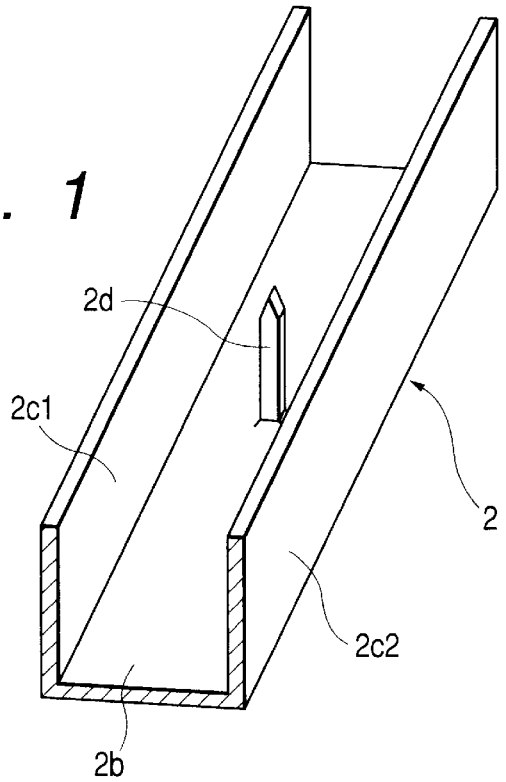
FIG. 1 is a perspective view showing the basic structure of a terminal of the present invention.

FIG. 1 is a perspective view showing the basic structure of a terminal 2 of the present invention, and the showing of a fitting portion and so on is omitted.

The terminal 2 includes a bottom wall 2*b*, and substantially-parallel side walls 2*c*1 and 2*c*2 extending upwardly from opposite side edges of the bottom wall 2*b*, respectively, and a pin 2*d* is formed on and extends upwardly from the bottom wall 2*b*. Preferably, a distal end of this pin 2*d* is pointed into a triangular shape.

Figure 2A:
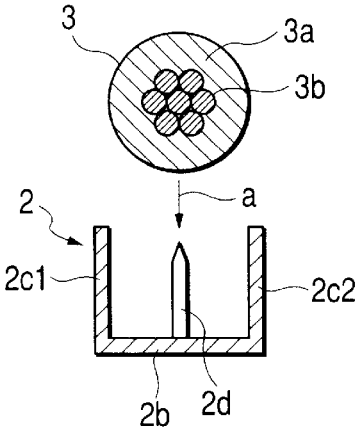
FIG. 2A is a cross-sectional view before connecting a wire.
Figure 2B:
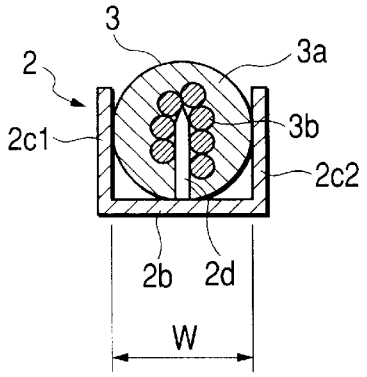
FIG. 2B is a cross-sectional view after connecting the wire.

As shown in FIG. 2A, a wire 3 is inserted between the side walls 2*c*1 and 2*c*2 from the upper side of the terminal 2, so that the wire 3 is pierced by the pin 2*d* as indicated by arrow a. As a result, the pin 2*d* pierces a sheath 3*a* of the wire 3, and is brought into contact with a conductor 3*b* within the wire, thereby connecting the terminal 2 to the wire 3, as shown in FIG. 2B.

The wire 3 is covered with the sheath made of a soft resin, such as vinyl, and when the pin 2*d* is caused to pierce the conductor 3*b* within the wire, wire elements can escape outwardly, and therefore the cutting of the wire elements is less liable to occur as compared with the conventional press-contacting terminal which grips the conductor by the press-contacting blades, and therefore the incomplete contact, caused by the cutting of the wire elements when the wire 3 is thin or thick, can be greatly reduced.

The wire 3 can be connected to the terminal 2 by inserting the wire 3 between the side walls 2*c*1 and 2*c*2 of the terminal 2 without the need for removing the sheath, and the connection processing can be effected utilizing facilities similar to those for the conventional press-contacting terminal.

Figure 21A:
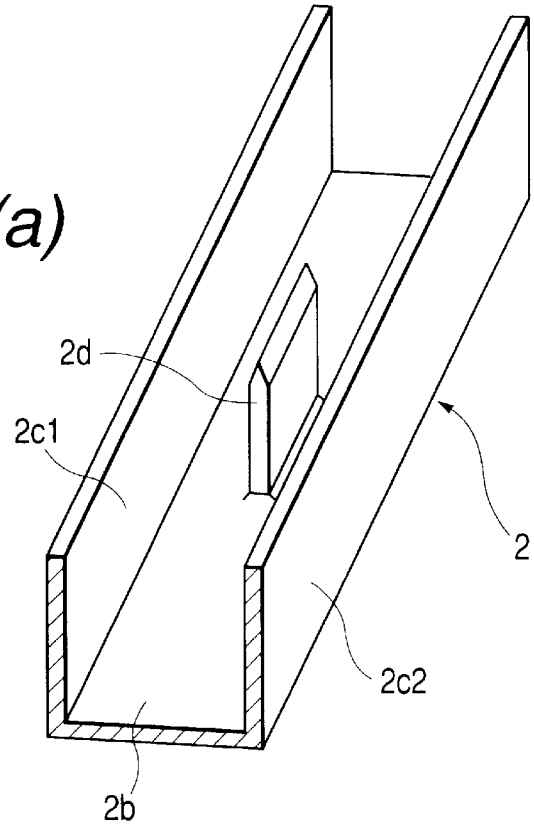
FIG. 21A is a perspective view of a terminal in which a flat plate-like pin has a sharp distal end edge.
Figure 21B:
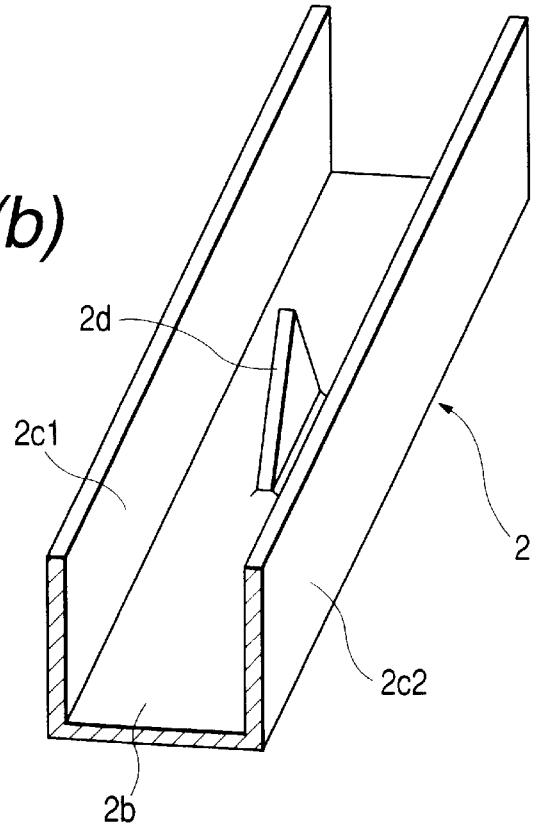
FIG. 21B is a perspective view of a terminal having a triangular plate-like pin.
Figure 22A:
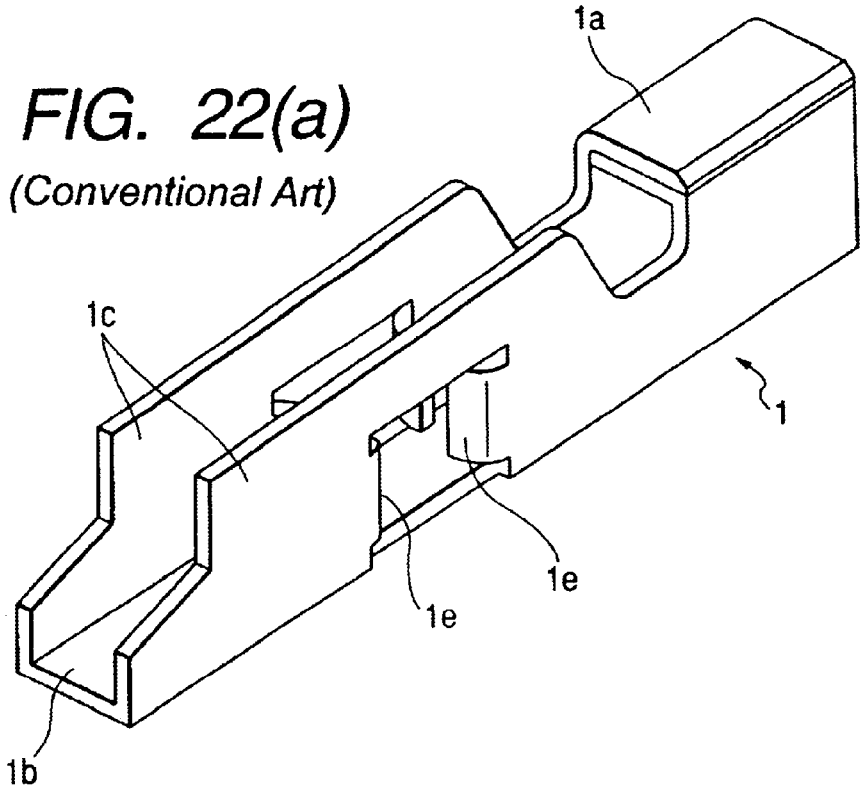
FIG. 22(a) (Conventional Art)
FIG. 22A is a perspective view.
Figure 22B:
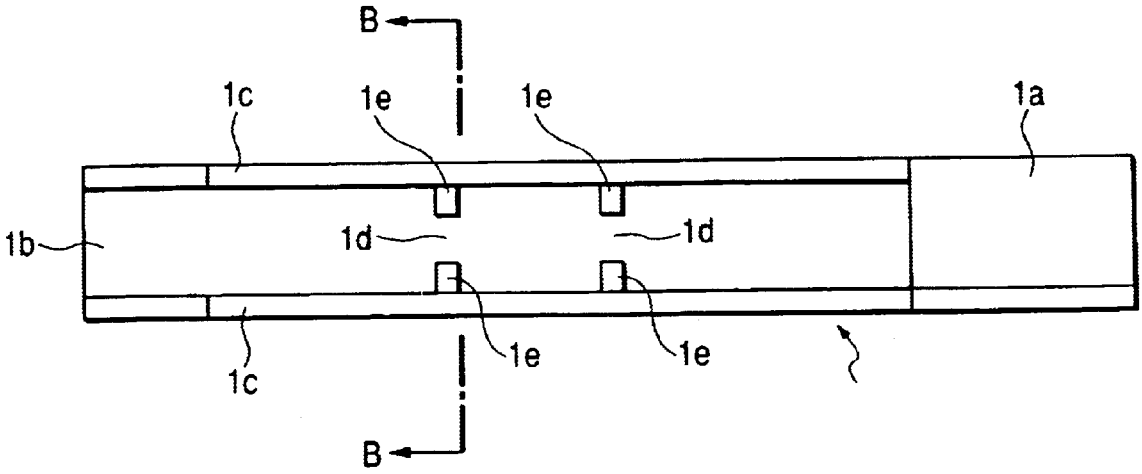
FIG. 22(b) (Conventional Art)
FIG. 22B is a plan view.
Figure 23:
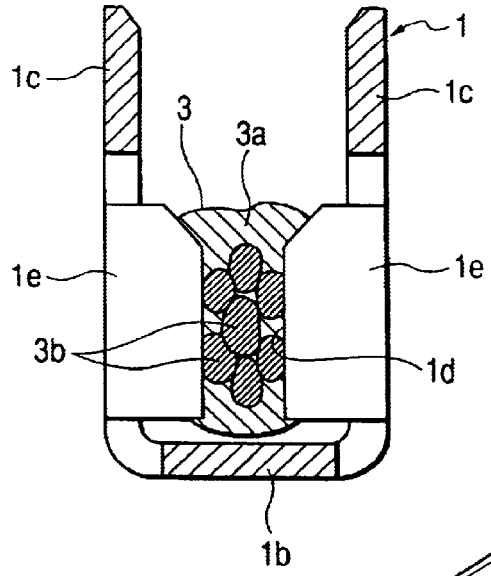
FIG. 23 (Conventional Art)
FIG. 23 is an enlarged, cross-sectional view taken along the line B—B of FIG. 22B.

With respect to the configuration of the pin 2*d*, the pin, shown in FIG. 1, has a plate-like shape, and has the distal end of a triangular shape. However, in view of the force of piercing into the wire 3 (that is, the force of piercing of the pin into the conductor through the sheath of the wire), the contact of the pin with the conductor 3*b*, and so on, the pin may include a narrow shank portion of a cylindrical shape and a distal end portion of a conical shape having a thin, pointed end like a push pin. In order to increase the area of contact with the wire elements of the wire, the pin may have a flat plate-shape or a triangular plate-shape with a sharp distal end, as shown in FIGS. 21A and 21B.

In view of the ability of contact with the conductor 3*b* and so on, preferably, the pin 2*d* is formed at a central portion of the bottom wall 2*b* in the direction of the width.

Although it is most preferred that the conductor 3*b* of the wire 3 includes a plurality of wire elements twisted together, there is a terminal of such a structure that even a single conductor wire element can be connected to this terminal as described later.

Preferably, the dimension W between the inner surfaces of the side walls 2*c*1 and 2*c*2 is slightly smaller than the outer diameter of the wire 3, and with this construction the wire 3 is gripped by the side walls 2*c*1 and 2*c*2 as shown in FIG. 2B, and the side walls 2*c*1 and 2*c*2 compress the sheath 3*a* of the wire 3, so that the pin 2*d* contacts the conductor 3*b* at a proper contact pressure, thereby preventing the wire 3 from being disengaged from the pin 2*d*.

Figure 3:
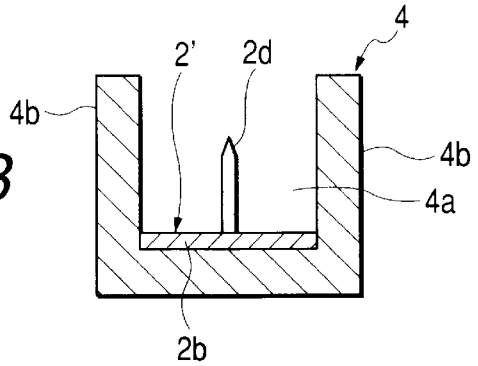
FIG. 3 is a cross-sectional view of a terminal having only a bottom wall and a pin.

In the terminal 2, the provision of the side walls can be omitted, in which case the structure has only the bottom wall 2*b* and the pin 2*d*. Namely, as shown in FIG. 3, the terminal 2', having only the bottom wall 2*b* and the pin 2*d*, is mounted in a cavity 4*a* in a connector 4, and the wire 3 is inserted between opposite side walls 4*b* of the cavity 4*a*, and is pierced by the pin 2*d*, thereby connecting the wire to the terminal.

Next, terminals, having such a structure that the wire 3 is positively prevented from disengagement from the pin 2*d*, will be described.

Figure 4A:
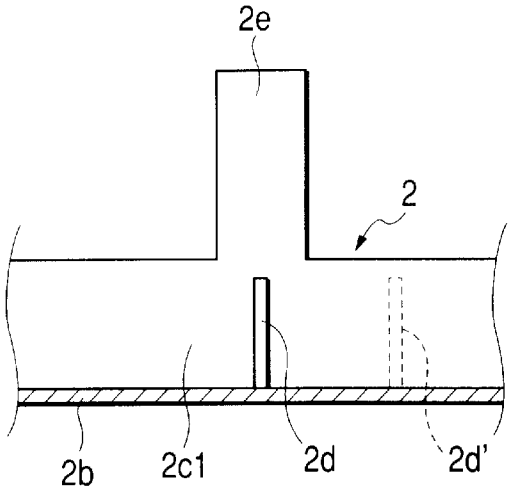
FIG. 4A is a side-elevational view.
Figure 4B:
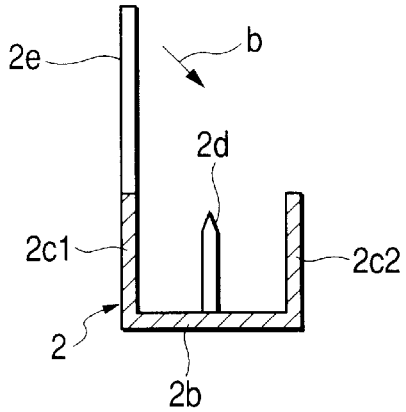
FIG. 4B is a cross-sectional view before connecting the wire.
Figure 4C:
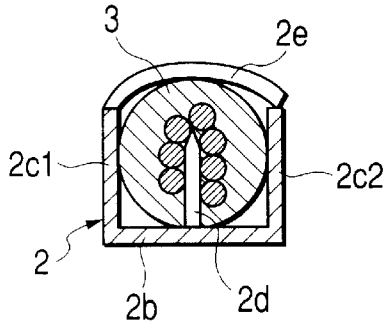
FIGS. 4C and 4D are cross-sectional views after connecting the wire.
Figure 4D:
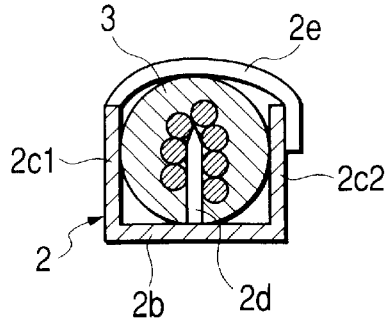

FIG. 4A is a side-elevational, cross-sectional view of a terminal 2 having a plate 2*e* formed on an upper edge of a side wall 2*c*1, FIG. 4B is a cross-sectional view of the terminal 2 before the wire is connected thereto, and FIGS. 4C and 4D are cross-sectional views of the terminal 2, showing a condition in which the wire is connected to the terminal, and the plate 2*e* is bent. The plate 2*e* is bent downwardly to cover the upper side of the wire 3 as shown in FIGS. 4C and 4D, and by doing so, the wire 3 can be positively prevented from disengagement from the pin 2*d*.

When the plate 2*e* is bent, the distal end of this plate 2*e* may not overlap the side wall 2*c*2 as shown in FIG. 4C or may overlap the side wall 2*c*2 as shown in FIG. 4D.

Even in the case where the pin 2*d* is offset in the forward-rearward direction with respect to the plate 2*e*, and is disposed at a position 2*d*' as indicated by broken lines in FIG. 4A, so that the plate 2*e* will not directly cover the pin 2*d*, but will cover only the upper side of the wire 3, the plate can fix the wire 3 to the terminal 2, thereby positively preventing the wire 3 from disengagement from the pin 2*d*. The positional relation between the plate 2*e* and the pin 2*d* can be determined arbitrarily.

Figure 5A:
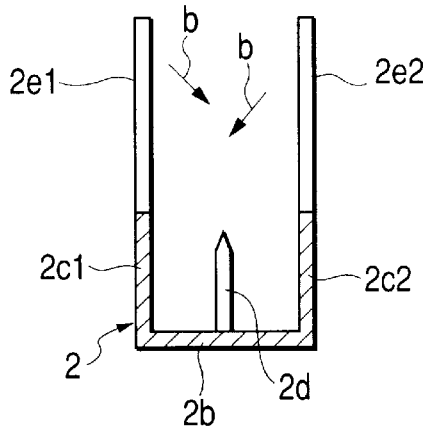
FIG. 5A is a cross-sectional view before connecting the wire.
Figure 5B:
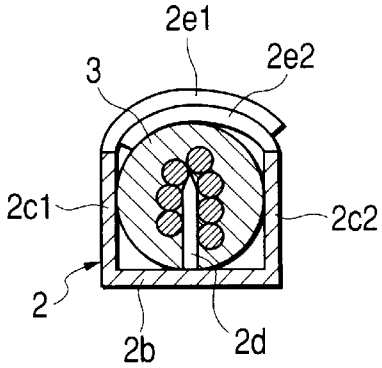
FIG. 5B is a cross-sectional view after connecting the wire.

FIG. 5A is a cross-sectional view of a terminal 2 having plates 2*e*1 and 2*e*2 formed respectively on upper edges of opposite side walls 2*c*1 and 2*c*2, and FIG. 5B is a cross-sectional view of the terminal 2, showing a condition in which the wire 3 is connected to the terminal, and the plates 2*e*1 and 2*e*2 are bent. As shown in FIG. 5B, the plates 2*e*1 and 2*e*2, formed respectively on the upper edges of the opposite side walls 2*c*1 and 2*c*2, are bent downwardly in overlapping relation to each other to cover the upper side of the wire 3 in a double manner, and by doing so, the wire 3 can be more positively prevented from disengagement from the pin 2*d*.

Figure 6A:
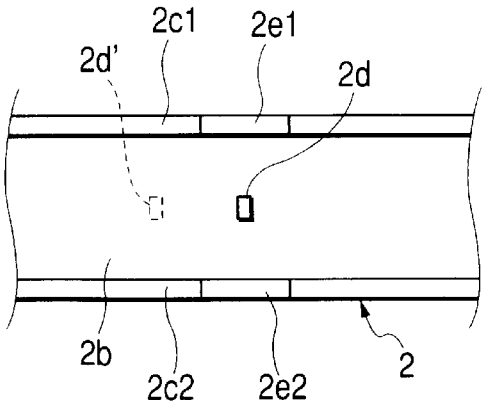
FIGS. 6A and 6B are plan views of terminals in which plates are formed on upper edges of opposite side walls, respectively.
Figure 6B:
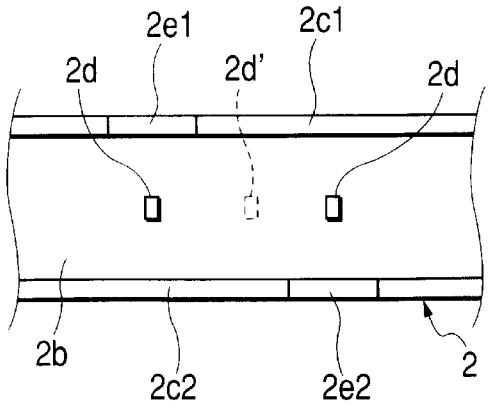

FIG. 6 shows examples of arrangements in which plates 2*e*1 and 2*e*2 are formed on opposite side walls 2*c*1 and 2*c*2, respectively. FIG. 6A is a plan view of a terminal in which the plates 2*e*1 and 2*e*2 are formed respectively on the opposite side walls 2*c*1 and 2*c*2 in opposed relation to each other, and FIG. 6B is a plan view of a terminal in which the plates 2*e*1 and 2*e*2 are formed respectively on the opposite side walls 2*c*1 and 2*c*2, and are arranged alternately in a forward-rearward direction.

In the case where the plates 2*e*1 and 2*e*2 are arranged as shown in FIG. 6A, with a pin 2*d* disposed between the opposed plates 2*e*1 and 2*e*2, the terminal 2 has a cross-section as shown in FIG. 5B when the plates 2*e*1 and 2*e*2 are bent after inserting the wire 3 therebetween.

In the case where the plates 2*e*1 and 2*e*2 are arranged as shown in FIG. 6B, with a pin 2*d* disposed in registry with one of the plates 2*e*1 and 2*e*2 arranged alternately in the forward-rearward direction, the terminal 2 has a cross-section as shown in FIG. 4C or FIG. 4D when the plates 2*e*1 and 2*e*2 are bent after inserting the wire 3 therebetween.

Even in the case where the pin 2*d* is offset in the forward-rearward direction with respect to the plates 2*e*1 and 2*e*2, and is disposed at a position 2*d*', so that the plates 2*e*1 and 2*e*2 will not directly cover the pin 2*d*, but will cover only the upper side of the wire 3, the plates can fix the wire 3 to the terminal 2, thereby positively preventing the wire 3 from disengagement from the pin 2*d*. The positional relation between the plates 2*e*1 and 2*e*2 and the pin 2*d* can be determined arbitrarily.

Figure 7A:
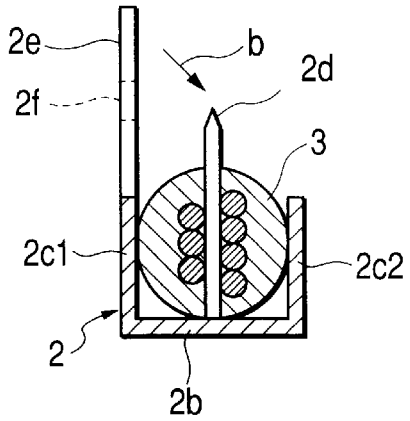
FIGS. 7A and 7B show a terminal in which a hole is formed through a plate formed on an upper edge of a side wall.
Figure 7B:
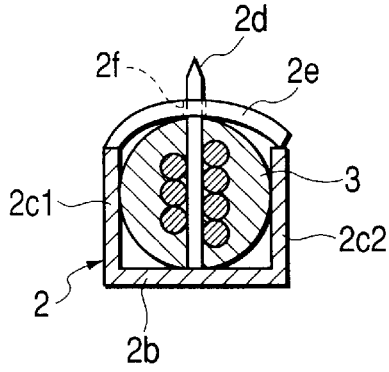

FIG. 7A is a cross-sectional view of a terminal in which a through hole 2*f* is formed through a plate 2*e* formed on an upper edge of a side wall 2*c*1, and FIG. 7B is a cross-sectional view of the terminal, showing a condition in which the wire 3 is connected to the terminal, and the plate 2*e* is bent. The plate 2*e* is bent downwardly to cover the upper side of the wire 3, with a distal end portion of a pin 2*d* passed through the through hole 2*f*, as shown in FIG. 7B, and by doing so, the wire 3 can be more positively prevented from disengagement from the pin 2*d*.

Figure 8A:
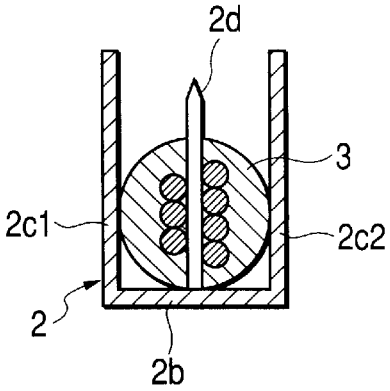
FIG. 8A is a cross-sectional view after connecting the wire.
Figure 8B:
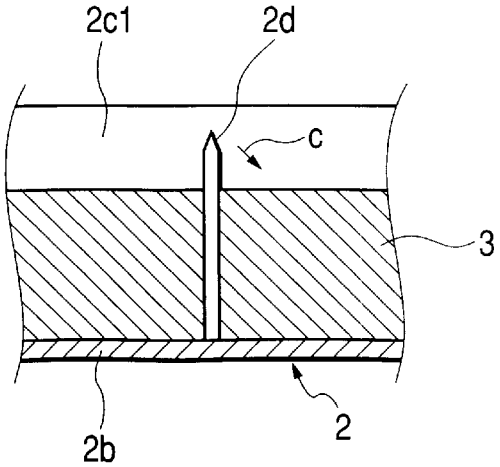
FIG. 8B is a side-elevational view before bending the pin.
Figure 8C:
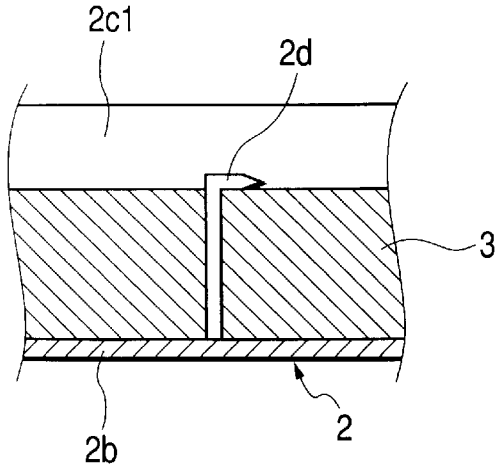
FIG. 8C is a side-elevational view after bending the pin.

FIG. 8 shows the process of bending a pin 2*d* to thereby fix the wire 3 to a terminal 2. FIG. 8A is a cross-sectional view showing a condition in which the wire 3 is connected to the terminal 2, FIG. 8B is a side-elevational view before the pin is bent, and FIG. 5C is a side-elevational view after the pin is bent. As shown in FIGS. 5B and 5C, the distal end portion of the pin 2*d*, piercing through the wire 3, is bent horizontally, so that the wire 3 is held between this distal end portion and a bottom wall 2*b*, thereby positively preventing the wire 3 from disengagement from the pin 2*d*.

The distal end portion of the pin 2*d*, piercing through the wire 3 and projecting outwardly from the plate 2*e* through the through hole 2*f* in the plate 2*e*, as shown in FIG. 7B, may be bent.

Next, terminals 2, having such a structure that the wire 3 can be smoothly inserted between side walls 2*c*1 and 2*c*2, will be described.

Figure 9A:
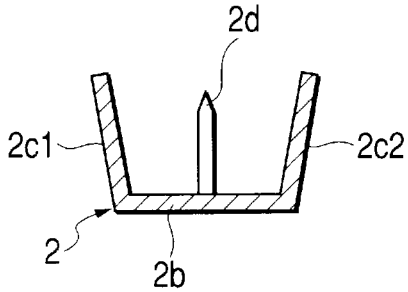
FIGS. 9A and 9B are cross-sectional views of terminals of such a structure that the wire can be smoothly inserted between side walls.
Figure 9B:
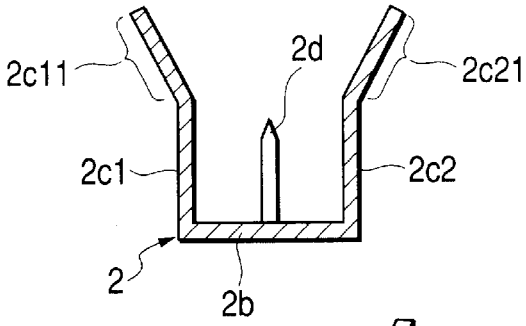

FIGS. 9A and 9B are cross-sectional views of the terminals 2, having such a configuration that side walls 2*c*1 and 2*c*2 are spread out at the upper open side. In the terminal 2 of FIG. 9A, the wholes of the side walls 2*c*1 and 2*c*2 are spread out upwardly to assume a generally inverted tapering shape. In the terminal 2 of FIG. 9B, upper portions 2*c*11 and 2*c*21 of the side walls 2*c*1 and 2*c*2 are spread out upwardly to assume a generally inverted tapering shape. In each of these terminals 2, the upwardly spread-out side walls 2*c*1 and 2*c*2 or the upwardly spread-out upper portions 2*c*11 and 2*c*21 of the side walls serve as a receiving port for receiving the wire 3, and prevent the misregistration of the wire 3 at the time of connecting the wire, and therefore the wire 3 can be smoothly inserted between the side walls 2*c*1 and 2*c*2.

With respect to the terminal of the structure shown in FIG. 9, even in the case where the side wall upper portions 2*c*11 and 2*c*21 are formed respectively not on the side walls but on the plates 2*e*1 and 2*e*2 described above in FIG. 5, similar effects can be obtained, and even in the case where the plates 2*e*1 and 2*e*2 are arranged as shown in either of FIG. 6A and FIG. 6B, these upper portions serve as a wire receiving port, and prevent the misregistration of the wire 3 at the time of connecting the wire, and therefore the wire 3 can be smoothly inserted between the side walls 2*c*1 and 2*c*2.

Next, methods of producing the terminal 2 will be described.

In one method of producing the terminal 2, the pin 2*d* is separate from a base material of the terminal 2, and the pin 2*d* can be joined to the base material of the terminal 2 by laser welding or the like (Production method 1).

FIGS. 1 to 9 show the terminals 2 produced by the production method 1, and each of the pins 2*d* is joined at its lower end to the bottom wall 2*b* of the terminal 2 by laser welding or the like.

In the production method 1, the pin 2*d*, made of a material having desired strength, electrical resistance and so on, can be formed in a desired position on the bottom wall 2*b*, and the terminal 2 of high quality can be produced.

In another method of producing the terminal 2, the pin 2*d* is formed integrally with a base material of the terminal 2, and the pin 2*d* can be formed by raising a stamped-out portion of the terminal 2 (Production method 2).

Figure 10:
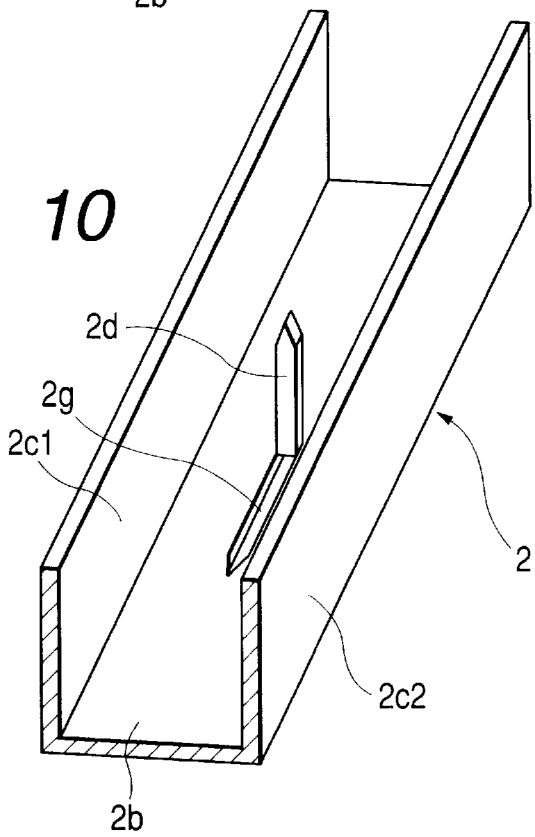
FIG. 10 is a perspective view of a terminal in which a pin is formed by stamping a relevant portion out of a base material of the terminal.

FIG. 10 is a perspective view showing the basic structure of a terminal 2 produced by the production method 2, and the showing of a fitting portion and so on is omitted. The terminal 2 of FIG. 10 includes a bottom wall 2*b* and side walls 2*c*1 and 2*c*2, and a pin 2*d*, stamped out of the bottom wall 2*b* and raised upwardly, is formed integrally with the terminal. Reference numeral 2*g* denotes a hole formed in the bottom wall 2*b* when the pin 2*d* is stamped out of the bottom wall 2*b*, and is raised.

In the production method 2, the pin 2*d* is formed by stamping the relevant portion out of the base material of the terminal 2 and then by raising it, and therefore, the pin can be formed by the method similar to a method of forming a press-contacting blade of a conventional press-contacting terminal, and the facilities for producing the conventional press-contacting terminals can be utilized, and therefore the terminals can be produced at low costs.

In the case where a plurality of pins are formed on the terminal as described later, the terminal can be produced, using a combination of the above two production methods 1 and 2.

Next, terminals 2, having a plurality of pins 2*d* formed on a bottom wall 2*b*, will be described.

Figure 11A:
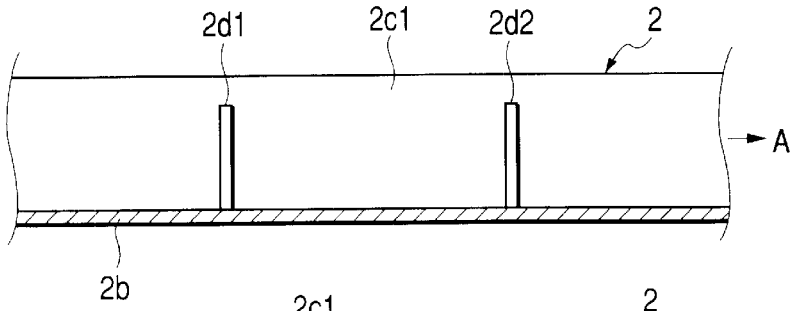
FIG. 11A is a side-elevational view.

FIG. 11A is a side-elevational view of a terminal in which two pins 2*d*1 and 2*d*2 are formed, and are spaced from each other in a direction parallel to side walls 2*c*1 and 2*c*21 and FIGS. 11B to 11E are plan views showing various arrangement patterns, respectively. In FIGS. 11A to 11E, a fitting portion is provided in a direction of arrow A. FIGS. 11B to 11E are plan views of the terminals, in which although the pins 2*d*1, as well as the pins 2*d*2, are disposed at the same position on the bottom wall 2*b*, the positions of pin-stamped-out holes 2*g*1 and 2*g*2 are different, and these Figures show the patterns of arrangement of the pins 2*d*1 and 2*d*2 and the patterns of arrangement of the pin-stamped-out holes 2*g*1 and 2*g*2.

Figure 11B:
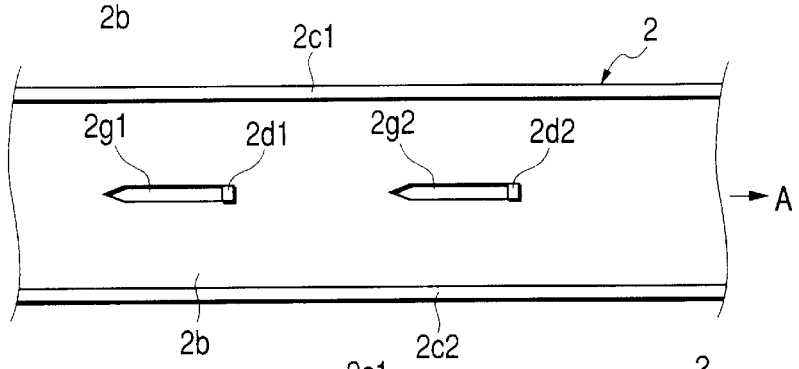
FIGS. 11B to 11E are plan views showing various arrangement patterns.
Figure 11C:
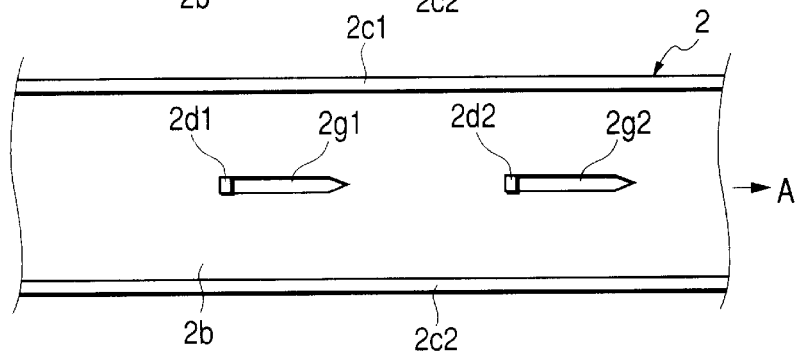

In FIGS. 11B and 11C, the pin-stamped-out holes 2*g*1 and 2*g*2 extend in the same direction from the pins 2*d*1 and 2*d*2, respectively.

Figure 11D:
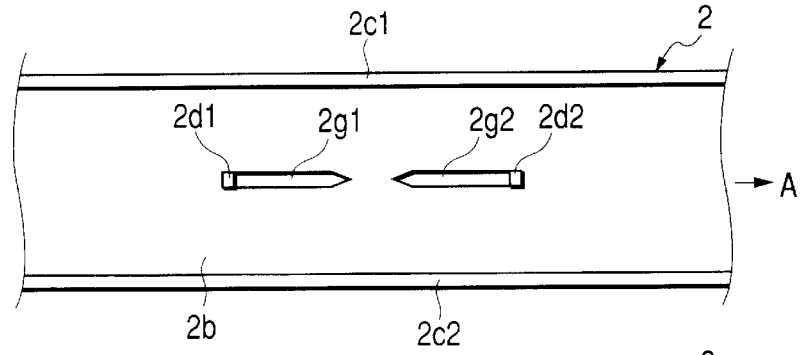

In FIG. 11D, the pin-stamped-out holes 2*g*1 and 2*g*2 extend in different directions, that is, inwardly toward each other from the pins 2*d*1 and 2*d*2, respectively.

Figure 11E:
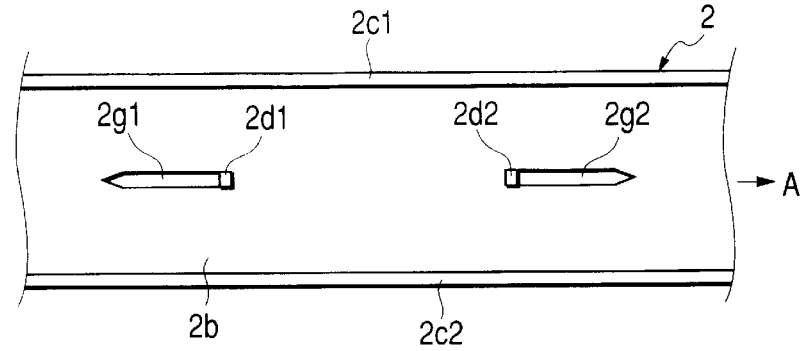

In FIG. 11E, the pin-stamped-out holes 2*g*1 and 2*g*2 extend in different directions, that is, outwardly away from each other from the pins 2*d*1 and 2*d*2, respectively.

By thus forming the plurality of pins, the area of contact of the terminal with the wire increases, thereby enhancing the contact reliability, and besides the frictional resistance between the pins 2*d* and the conductor 3*b* increases, thereby preventing the wire 3 from disengagement from the pins 2*d*.

Figure 12A:
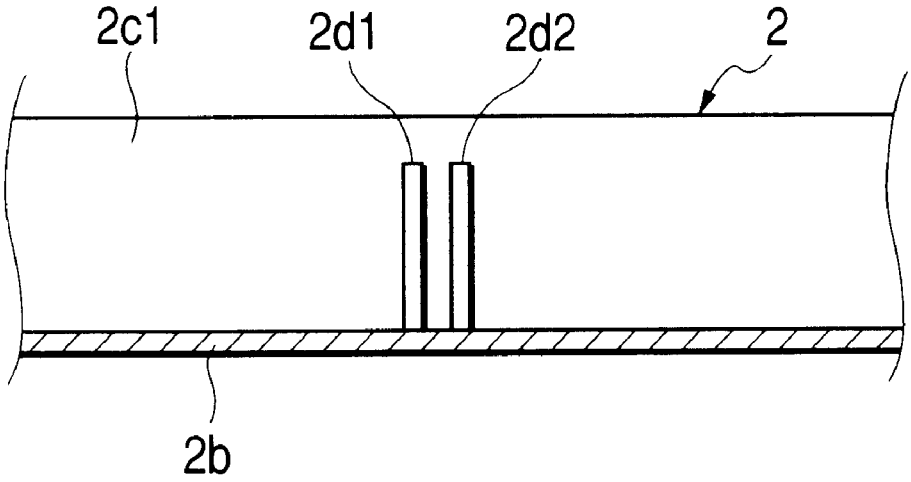
FIG. 12A is a side-elevational view.
Figure 12B:
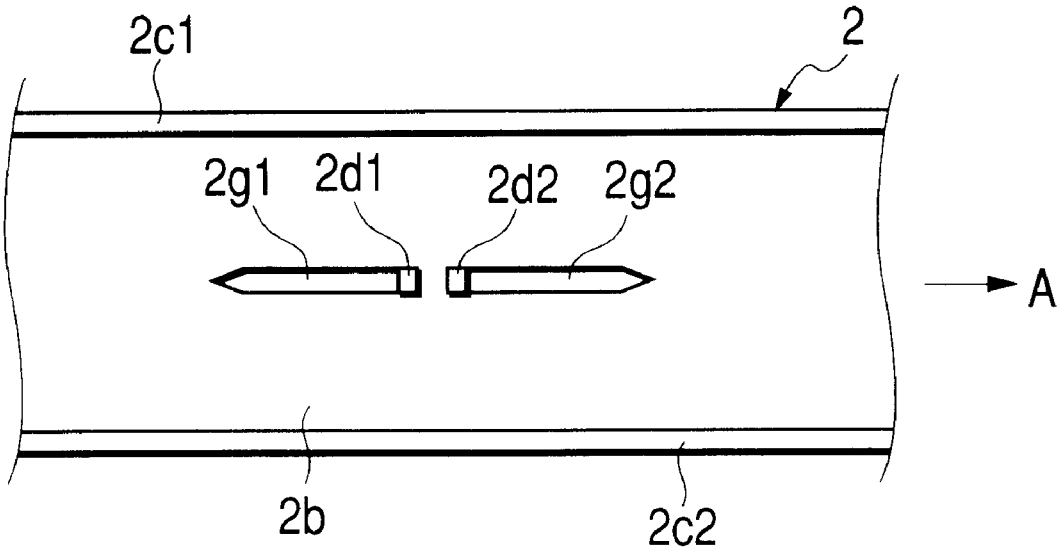
FIG. 12B is a plan view.

In the arrangement pattern of FIG. 11E among the above arrangement patterns, the pin-stamped-out holes 2*g*1 and 2*g*2 are disposed outwardly relative to the pins 2*d*1 and 2*d*2, respectively, and therefore the distance between the pins 2*d*1 and 2*d*2 can be freely set to a desired value, and as shown in FIGS. 12A and 12B, the distance between the pins 2*d*1 and 2*d*2 can be made as short as possible (so that the two pins are disposed in close proximity to each other) in so far as the strength and so on of the base material of the terminal allows such an arrangement. FIG. 12A is a side-elevational view of the terminal in which the pins 2*d*1 and 2*d*2 are formed in close proximity to each other, and FIG. 12B is a plan view thereof.

By thus forming the pins 2*d*1 and 2*d*2 in close proximity to each other as shown in FIG. 12, the resilient force of the two pins 2*d*1 and 2*d*2 against the wire 3 can be concentrated on a narrow range when inserting the two pins 2*d*1 and 2*d*2 into the wire 3, so that these pins can pierce the wire 3 with a large force.

Figure 13A:
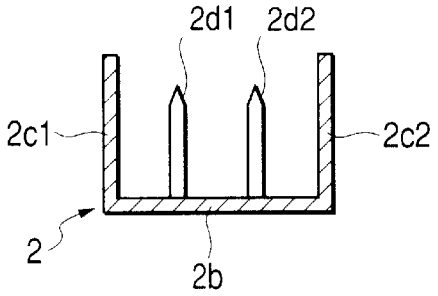
FIG. 13A is a cross-sectional view.
Figure 13B:
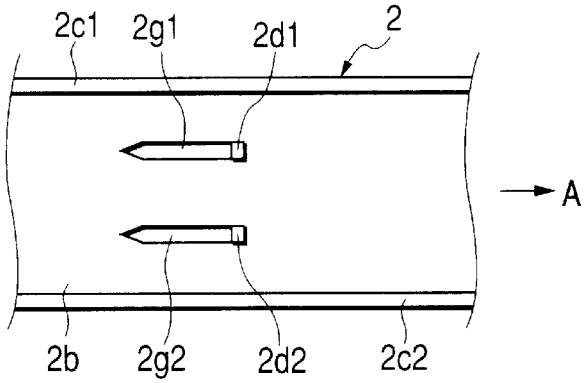
FIGS. 13B to 13D are plan views showing various arrangement patterns.
Figure 13C:
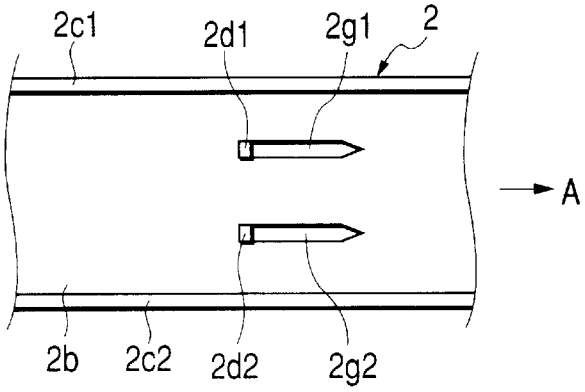
Figure 13D:
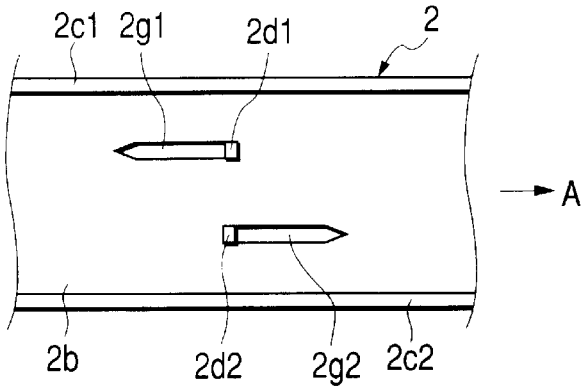

FIG. 13A is a cross-sectional view of a terminal in which two pins 2*d*1 and 2*d*2 are formed, and are spaced from each other in a direction perpendicular to side walls 2*c*1 and 2*c*2, and FIGS. 13B to 13D are plan views showing various arrangement patterns, respectively. In FIGS. 13B to 13D, a fitting portion is provided in a direction of arrow A. FIGS. 13B to 13D are plan views of the terminals, in which although the pins 2*d*1, as well as the pins 2*c*, are disposed at the same position on a bottom wall 2*b*, the positions of pin-stamped-out holes 2*g*1 and 2*g*2 are different, and these Figures show the patterns of arrangement of the pins 2*d*1 and 2*d*2 and the patterns of arrangement of the pin-stamped-out holes 2*g*1 and 2*g*2.

In FIGS. 13B and 13C, the pin-stamped-out holes 2*g*1 and 2*g*2 extend in the same direction from the pins 2*d*1 and 2*d*2, respectively.

In FIG. 13D, the pin-stamped-out holes 2*g*1 and 2*g*2 extend in different directions from the pins 2*d*1 and 2*d*2, respectively.

By thus forming the two pins 2*d*1 and 2*d*2, generally similar effects as described above for FIG. 11 can be obtained.

The terminal 2, in which the two pins 2*d*1 and 2*d*2 are spaced from each other in the direction perpendicular to the side walls 2*c*1 and 2*c*1 as shown in FIG. 13, is effective particularly in the case where the wire 3 is a thick wire (having a conductor including a large number of wire elements), or the wire 3 has a conductor including a single wire element.

Figure 14A:
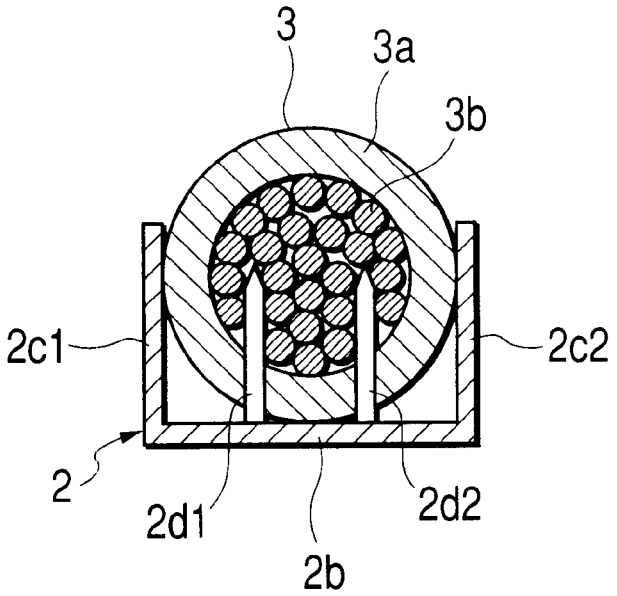
FIG. 14A is a cross-sectional view showing a thick wire connected to the terminal.

FIG. 14A is a cross-sectional view of the terminal 2 to which the thick wire 3 is connected, and the two pins 2*d*1 and 2*b*2 pierce the conductor 3*b* within the wire, and grip wire elements of the conductor 3*b*, and by doing so, the wire 3 can be positively prevented from disengagement from the pins 2*d*1 and 2*d*2 even in the case where the wire 3 is thick.

Figure 14B:
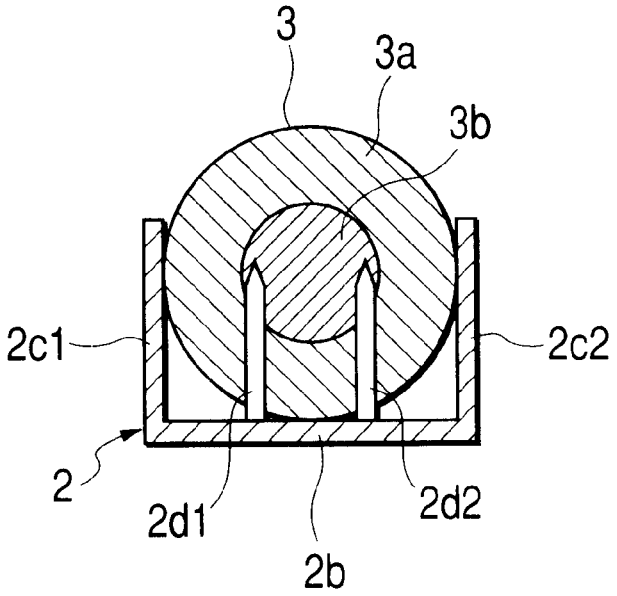
FIG. 14B is a cross-sectional view showing a wire (comprising a conductor including a single wire element) connected to the terminal.

In FIG. 14B, the wire 3 has the conductor 3*b* including a single wire element, and in this case the wire 3 can be connected to the terminal 2 by grippingly holding the conductor 3*b* between the two pins 2*d*1 and 2*d*2 spaced from each other in the direction perpendicular to the side walls 2*c*1 and 2*c*2.

Figure 15A:
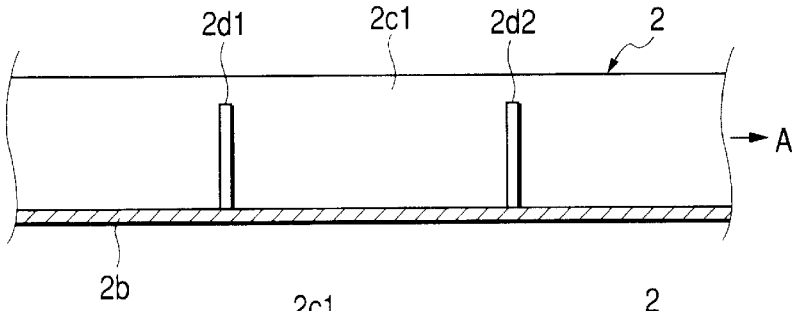
FIG. 15A is a side-elevational views.

FIG. 15A is a side-elevational view of a terminal in which two pins 2*d*1 and 2*d*2 are formed, and are spaced from each other in a direction oblique relative to side walls (that is, at a predetermined angle relative to the side walls other than in a direction parallel to the side walls and a direction perpendicular to the side walls), and FIGS. 15B to 15E are plan views showing various arrangement patterns, respectively. In FIGS. 15A to 15E, a fitting portion is provided in a direction of arrow A. FIGS. 15B to 15E are plan views of the terminals, in which although the pins 2*d*1, as well as pins 2*d*2, are disposed at the same position on a bottom wall 2*b*, the positions of pin-stamped-out holes 2*g*1 and 2*g*2 are different, and these Figures show the patterns of arrangement of the pins 2*d*1 and 2*d*2 and the patterns of arrangement of the pin-stamped-out holes 2*g*1 and 2*g*2.

Figure 15B:
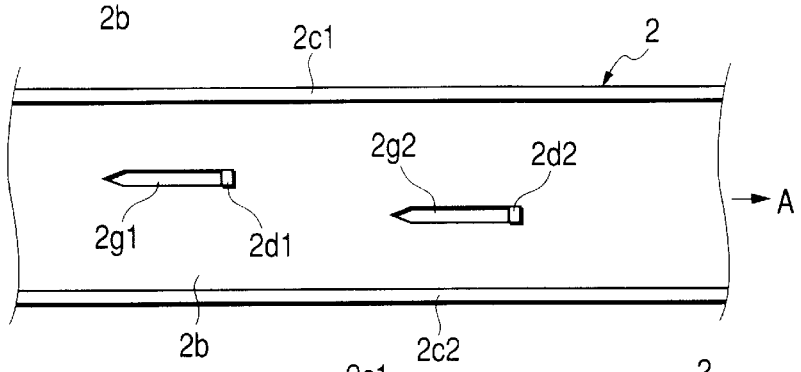
FIGS. 15B to 15E are plan views showing various arrangement patterns.
Figure 15C:
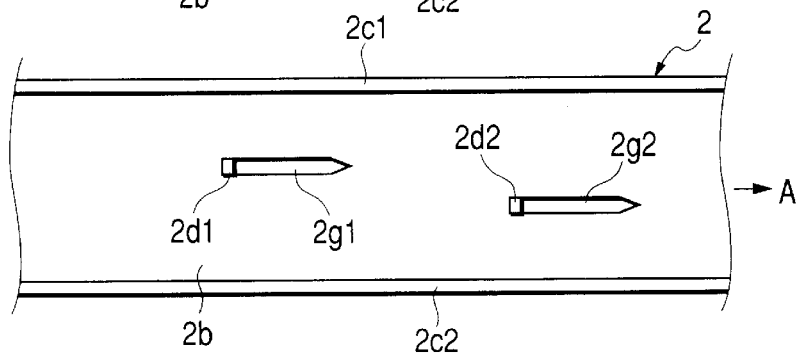

In FIGS. 15B and 15C, the pin-stamped-out holes 2*g*1 and 2*g*2 extend in the same direction from the pins 2*d*1 and 2*d*2, respectively.

Figure 15D:
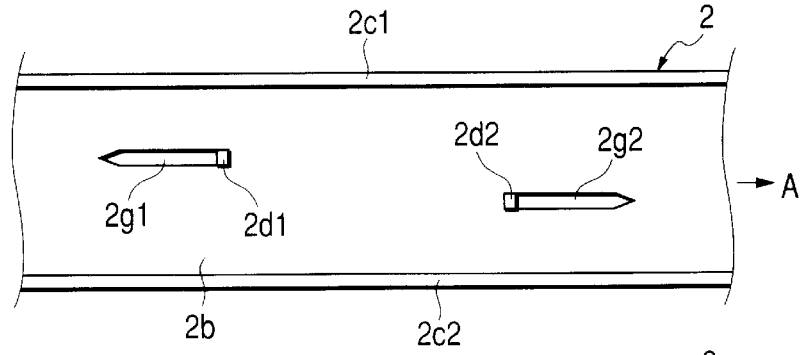

In FIG. 15D, the pin-stamped-out holes 2*g*1 and 2*g*2 extend in different directions, that is, outwardly from the pins 2*d*1 and 2*d*2, respectively.

Figure 15E:
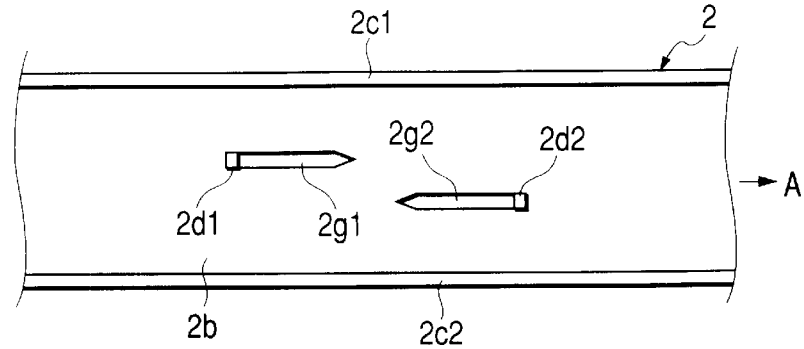

In FIG. 15E, the pin-stamped-out holes 2*g*1 and 2*g*2 extend in different directions, that is, inwardly from the pins 2*d*1 and 2*d*2, respectively.

By thus forming the two pins 2*d*1 and 2*d*2, generally similar effects as described above for FIG. 11 can be obtained.

Figure 16A:
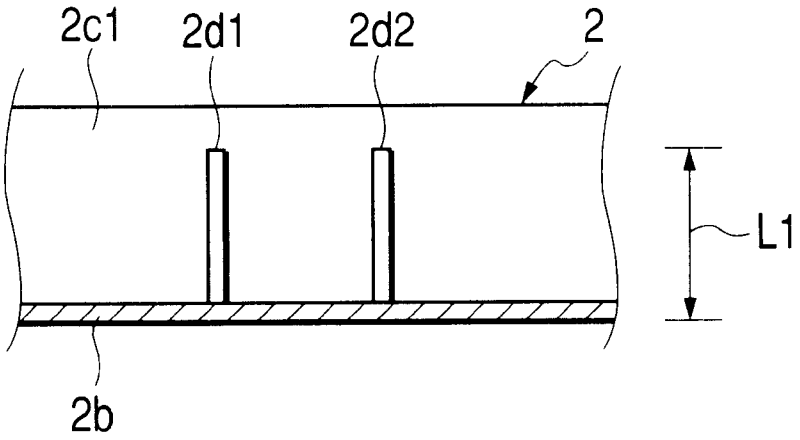
FIG. 16A is a side-elevational view.
Figure 16B:
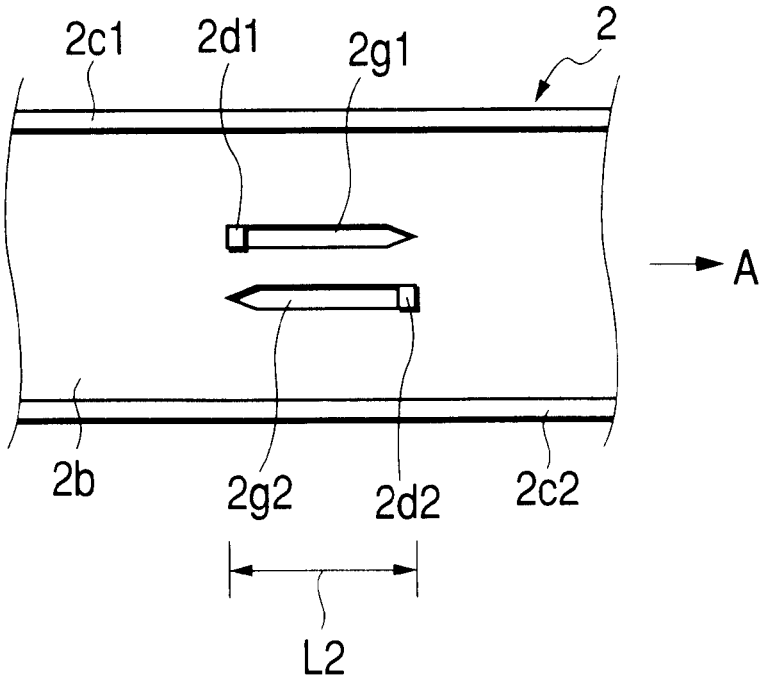
FIG. 16B is a plan view.

In the above arrangement patterns, the pins 2*d*1 and 2*d*2 are arranged such that these pins are spaced from each other in the oblique direction, and therefore as compared with the construction of FIG. 11 (in which the pins are arranged in the direction parallel to the side walls) and the construction of FIG. 13 (in which the pins are arranged in the direction perpendicular to the side walls), the degree of freedom of setting of the length and spacing of the pins 2*d*1 and 2*d*2 is higher, and therefore this construction is suited for the small-size design of the terminal. For example, a terminal 2 of FIG. 16 is a modified form of the terminal having the arrangement pattern of FIG. 15E, and in this terminal, the distance L2 between pins 2*d*1 and 2*d*2 is generally equal to the height L1 of the pins 2*d*1 and 2*d*2. FIG. 16A is a side-elevational view, and FIG. 16B is a cross-sectional view. As can be seen from FIG. 16B, the two pins can be stamped out and raised at an area of a bottom wall 2*b* having a width generally equal to the height L1 of the pins, and the terminal of a small size can be produced by the production method 2 (in which the pin is formed by stamping the relevant portion out of the base material and then by raising it).

In the terminal 2, a plurality of pins can be formed using a combination of the arrangement patterns of FIGS. 11B to 11E, FIGS. 13B to 13D and FIGS. 15B to 15E.

Figure 17A:
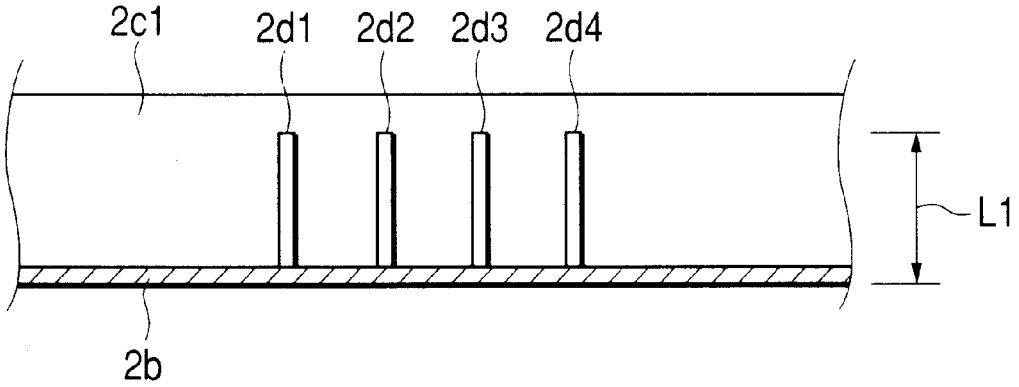
FIG. 17A is a side-elevational view.
Figure 17B:
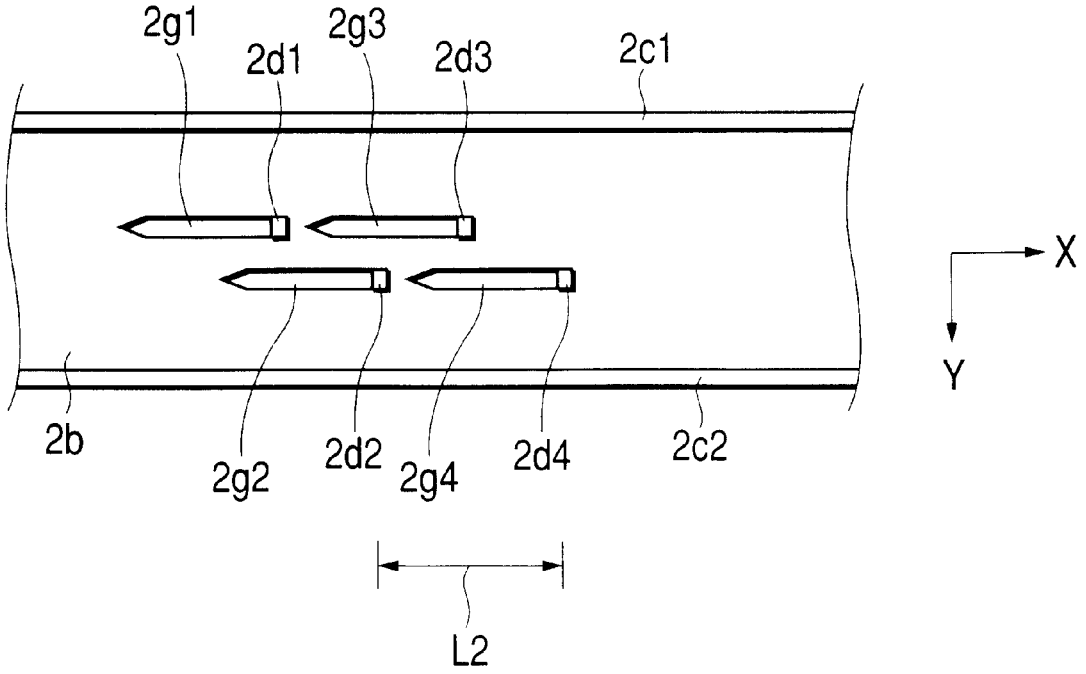
FIG. 17B is a plan view.

FIG. 17 shows a terminal having four pins 2*d*1 to 2*d*4 arranged on a bottom wall 2*b*, and the pins 2*d*1 and 2*d*3 are spaced from the pins 2*d*2 and 2*d*4 in a direction Y (that is, a direction perpendicular to side walls), and one row of pins 2*d*1 and 2*d*3 are offset relative to the other row of pins 2*d*2 and 2*d*4 in a direction X (that is, a direction parallel to the side walls) in such a manner that the pin 2*d*2 is disposed midway between the pins 2*d*1 and 2*d*3, and pin-stamped-out holes 2*g*1 to 2*g*4 extend in the same direction from the pins 2*d*1 to 2*d*4, respectively.

By arranging the pins as shown in FIG. 17, the plurality of pins 2*d*1 to 2*d*4 can be arranged at a high density in the direction X (parallel to the side walls), and therefore the terminal 2 can be formed into a small-size design. By reducing the amount of spacing of the two rows (in the direction Y) to a required minimum value, the pins 2*d*1 to 2*d*4 can be caused to pierce a widthwise (direction Y) central portion of the wire 3 in a concentrated manner.

Figure 18A:
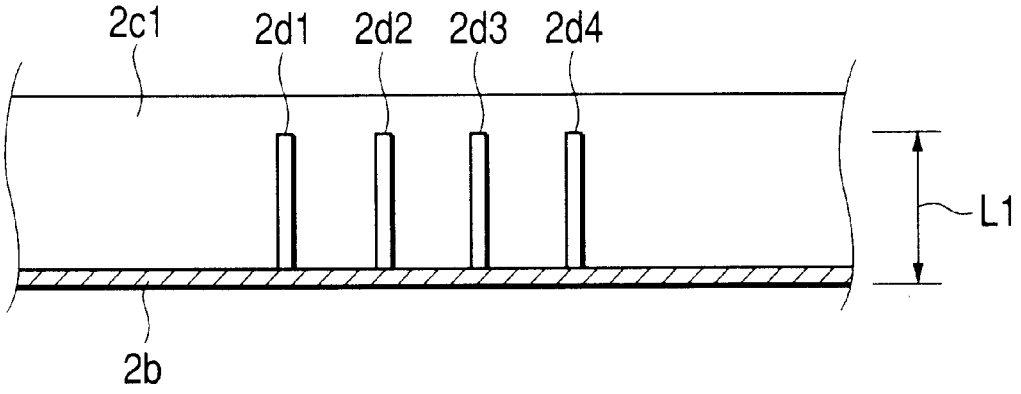
FIG. 18A is a side-elevational view.
Figure 18B:
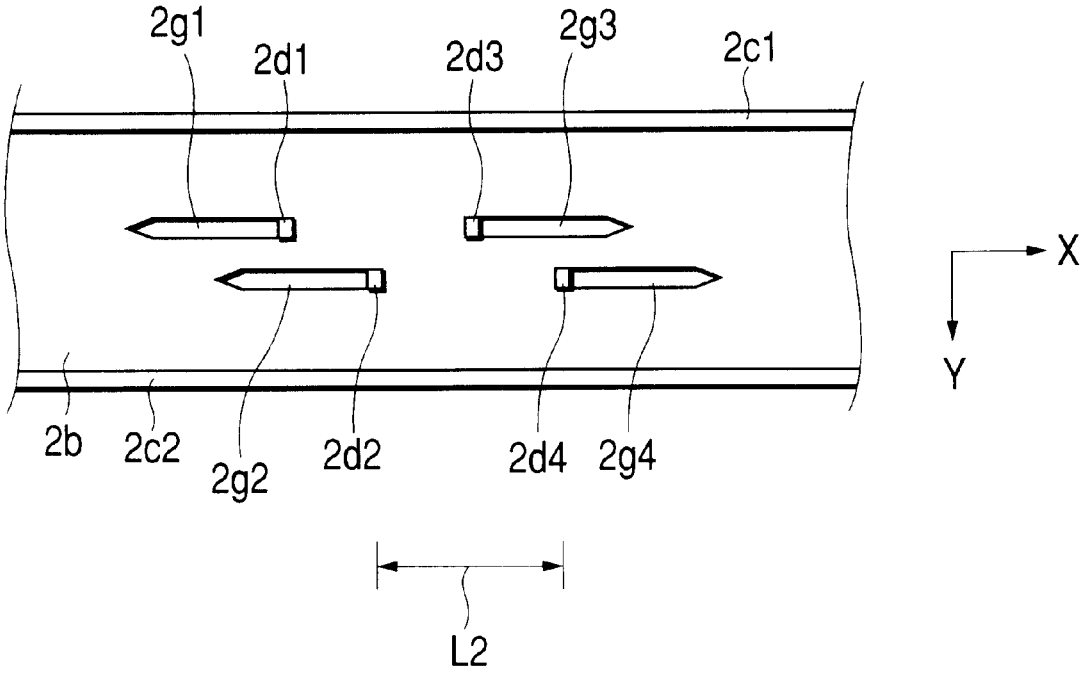
FIG. 18B is a plan view.

FIG. 18 shows a terminal in which four pins 2*d*1 to 2*d*4 are arranged on a bottom wall 2*b* as in FIG. 17, and pin-stamped-out holes 2*g*1 and 2*g*3 (2*g*2 and 2*g*4) extend in opposite directions, that is, outwardly away from each other from the pins 2*d*1 and 2*d*3 (2*g*2 and 2*g*4), respectively.

In the arrangement of FIG. 18, also, the wire-inserting pressure is distributed to the plurality of pins 2*d*1 to 2*d*4 as in the arrangement of FIG. 17, and therefore the pins 2*d*1 to 2*d*4 are positively prevented from being brought down by the wire-inserting pressure. With respect to the difference between the arrangement of FIG. 17 and the arrangement of FIG. 18, the pin-stamped-out hole 2*g*3 (2*g*4) is disposed between the pins 2*d*1 and 2*d*3 (2*d*2 and 2*d*4) in the arrangement of FIG. 17, and therefore the height L1 of the pins 2*d*1 to 2*d*4 can not be made larger than the pin spacing L2. On the other hand, in the arrangement of FIG. 18, the pin-stamped-out holes 2*g*1 and 2*g*3 (2*g*2 and 2*g*4) extend in the opposite directions, that is, outwardly away from each other from the pins 2*d*1 and 2*d*3 (2*g*2 and 2*g*4), respectively, and therefore the height L1 of the pins 2*d*1 to 2*d*4 can be made larger than the pin spacing L2.

Figure 19A:
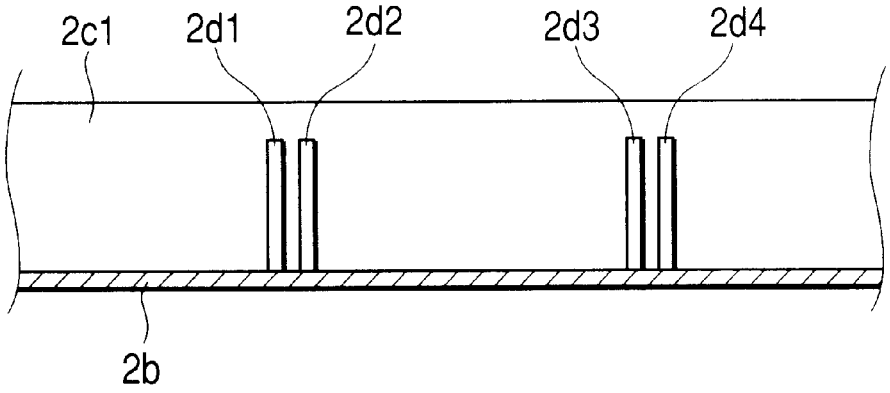
FIG. 19A is a side-elevational view.
Figure 19B:
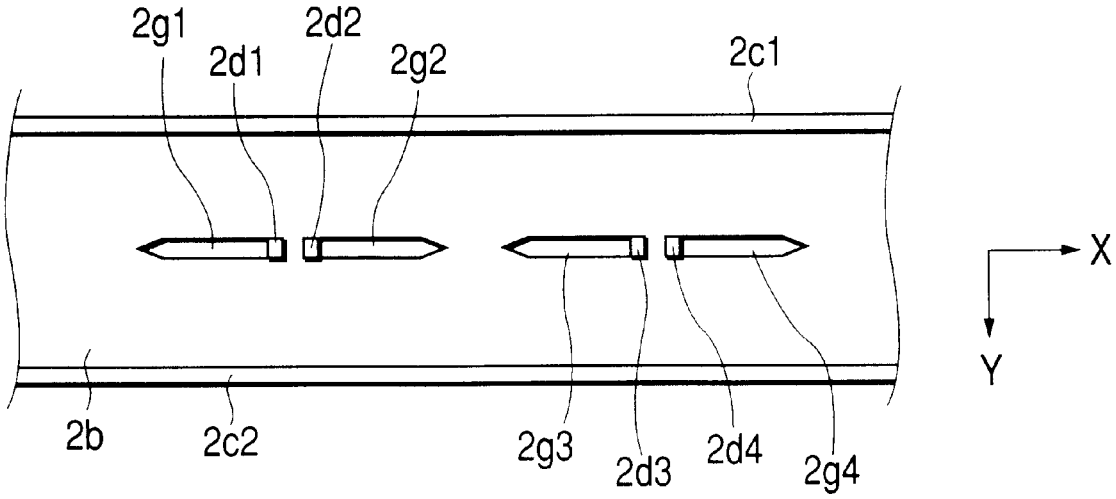
FIG. 19B is a plan view.

FIG. 19 shows a terminal in which four pins 2*d*1 to 2*d*4 are arranged on a bottom wall 2*b*, and the pins 2*d*1 and 2*d*2, as well as the pins 2*d*3 and 2*d*4, are disposed in close proximity to each other, and are spaced from each other in a direction X (that is, a direction parallel to side walls) as in FIG. 12.

By thus arranging the pins 2d1 and 2d2, as well as the pins 2d3 and 2d4, in close proximity to each other as shown in FIG. 19, the resilient force of the pins against the wire 3 can be concentrated on a narrow range, so that the pins can pierce the wire 3 with a large force.

Figure 20A:
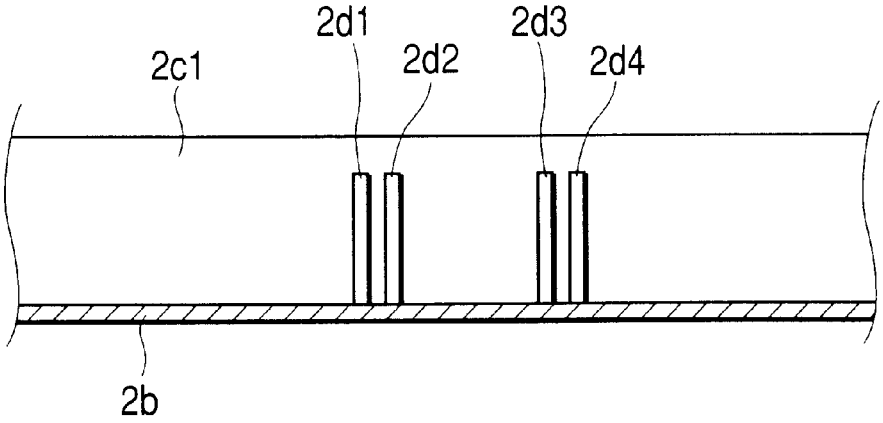
FIG. 20A is a side-elevational view.
Figure 20B:
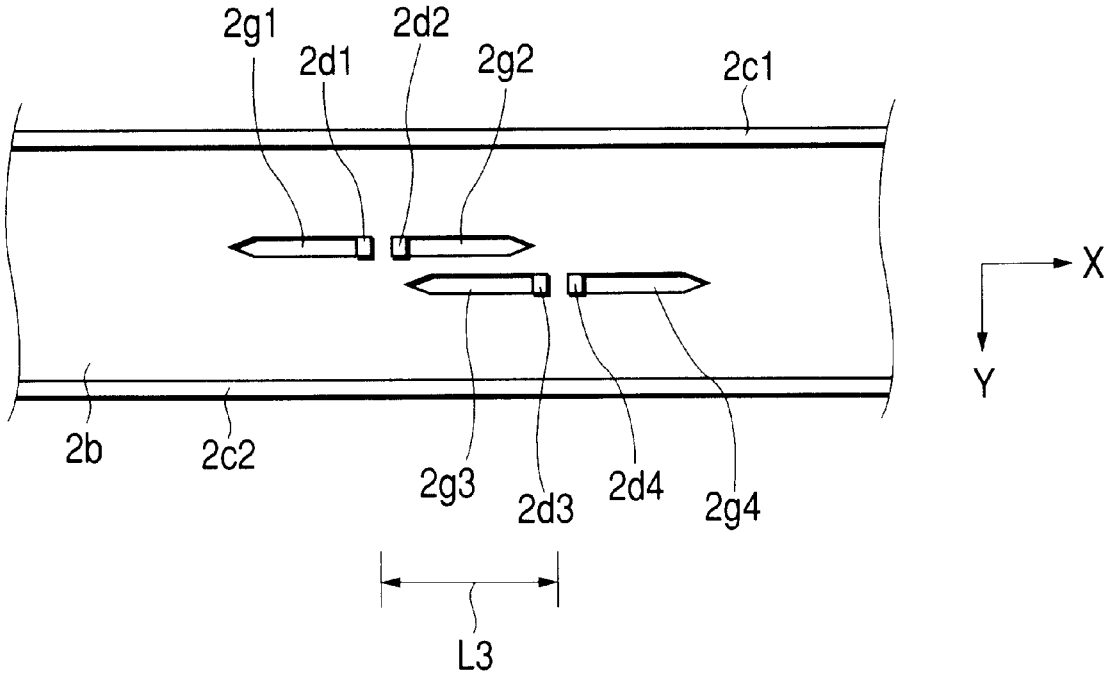
FIG. 20B is a plan view.

FIG. 20 shows a terminal in which pins 2d1 and 2d2, as well as pins 2d3 and 2d4, are disposed in close proximity to each other, and the pins 2d1 and 2d2 are spaced from the pins 2d3 and 2d4 in a direction Y (that is, a direction perpendicular to side walls), and are arranged obliquely thereto. With this arrangement, similar effects as described above for FIG. 19 can be obtained. In the arrangement of FIG. 20, the pins 2d1 and 2d2 are spaced from the pins 2d3 and 2d4 in the direction Y, and therefore the distance L3 between the pin 2d2 and the pin 2d3 can be more reduced as compared with the arrangement of FIG. 19, and the terminal 2 can be formed into a small-size design.

Figure 24:
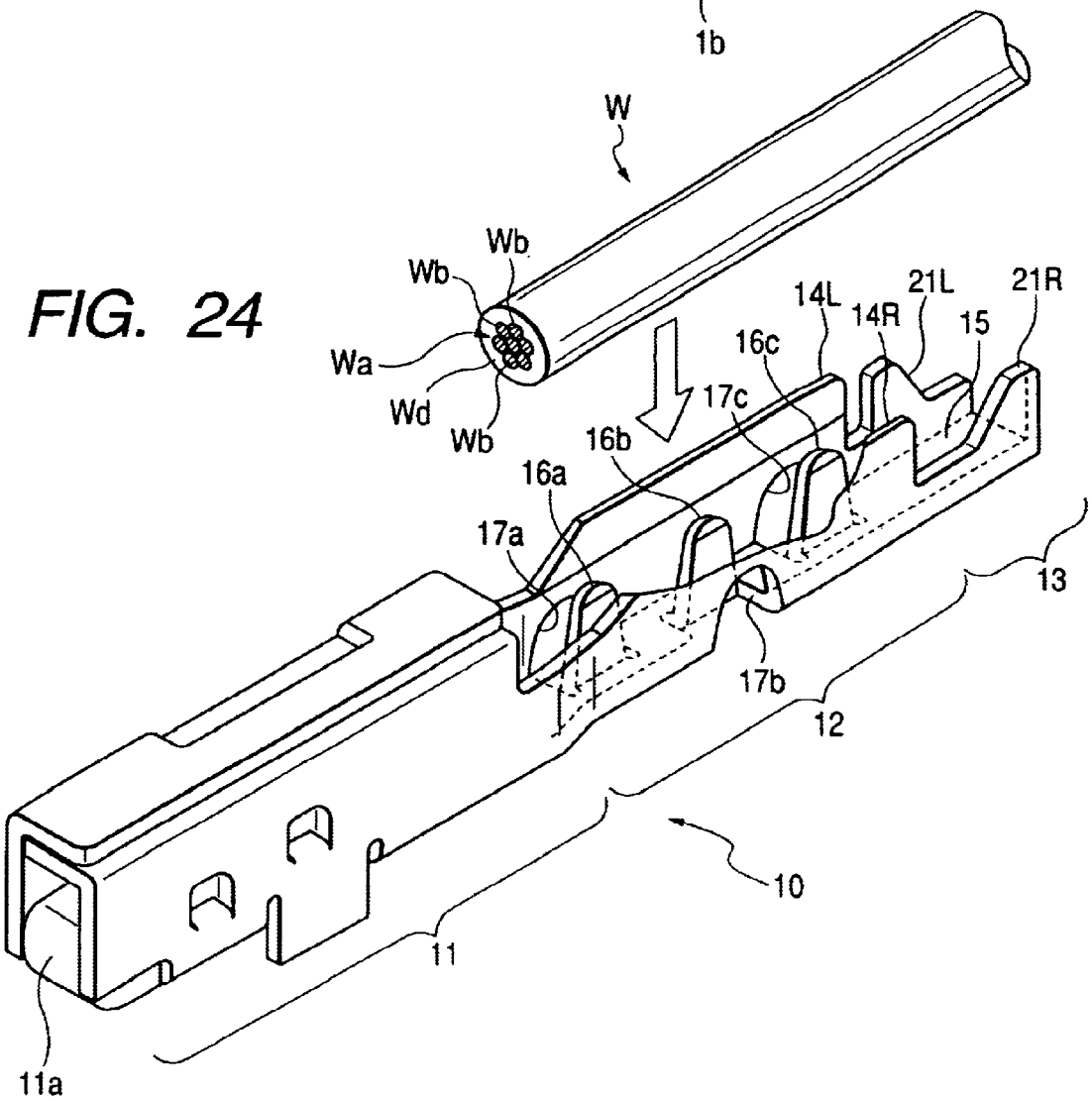
FIG. 24 is a perspective view showing the appearance of a preferred embodiment of a piercing terminal of the invention, as well as the appearance of a wire, before they are connected together.
Figure 25A:
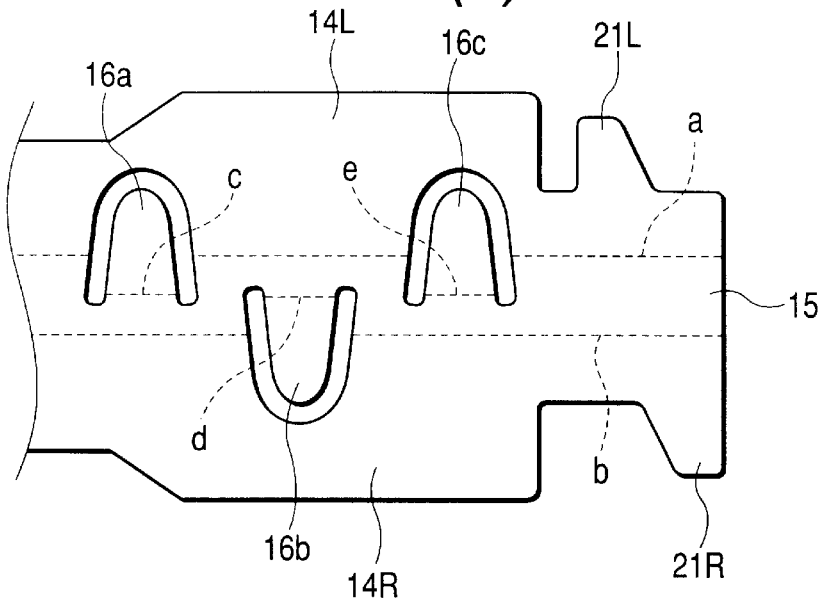
FIG. 25A is a developed view of a wire connection portion of the piercing terminal of FIG. 24 before a bending operation.
Figure 25B:
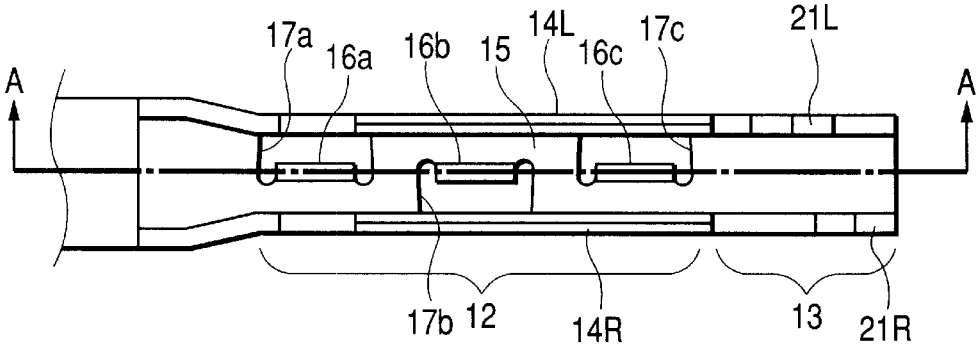
FIG. 25B is a top plan view after the bending operation.
Figure 25C:
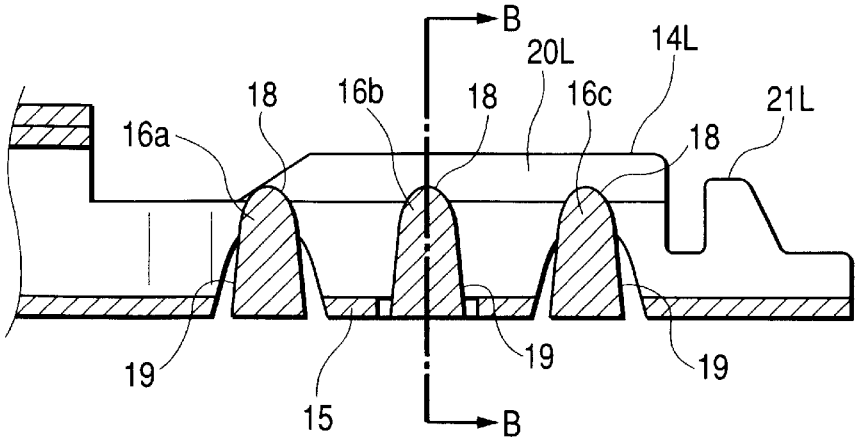
FIG. 25C is a cross-sectional view taken along the line A—A of FIG. 25B.
Figure 26A:
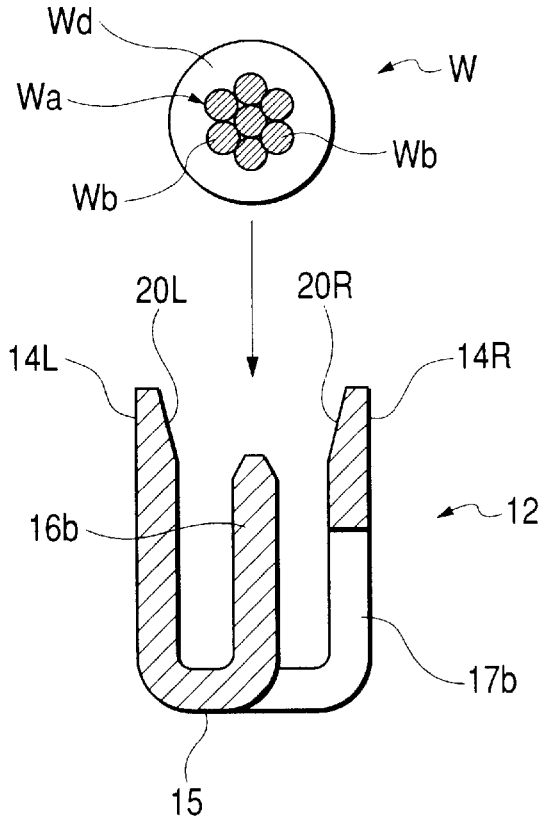
FIGS. 26A and 26B are cross-sectional views taken along the line B—B of FIG. 25C, explaining the connection of the wire to a piercing portion.
Figure 26B:
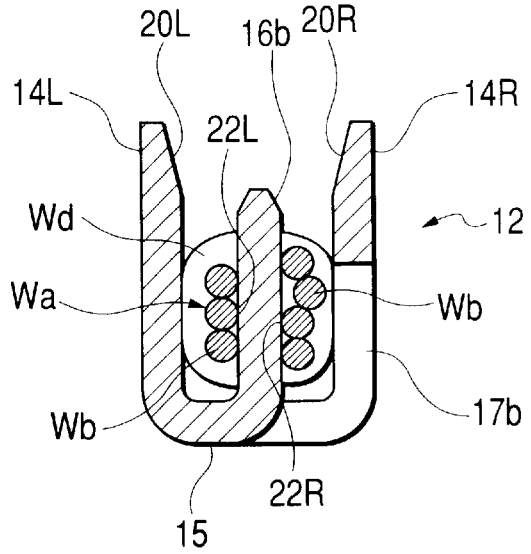

A preferred embodiment of a piercing terminal of the present invention will now be described in detail with reference to the drawings. FIG. 24 is a view showing the appearance of the piercing terminal and the appearance of a wire before they are connected together, FIG. 25A is a developed view of a wire connection portion of the piercing terminal before a bending operation, FIG. 25B is a top plan view after the bending operation, FIG. 25C is a cross-sectional view taken along the line A—A of FIG. 25B, and FIGS. 26A and 26B are cross-sectional views taken along the line B—B of FIG. 25C, explaining the connection of the wire to a piercing portion.

In this embodiment, the wire W, shown in FIG. 24, comprises a conductor Wa, including a plurality of wire elements (soft copper wires) Wb, Wb, . . . twisted together into a bundle, and an insulating sheath Wd which is made of an electrically-insulating soft resin material (such as vinyl), and covers the conductor Wa.

The piercing terminal 10 to be connected to an end portion of the wire W is formed by blanking and bending an electrically-conductive material such as a heat-resistance copper alloy, and this piercing terminal includes a fitting tubular portion 11, serving as a portion for connection to a terminal in a mating connector (not shown), the wire connection portion 12 for receiving the end portion of the wire W to be electrically connected thereto, and a press-clamping portion 13 for press-claming the insulating sheath Wd.

The fitting tubular portion 11, provided at a front portion of the terminal, is formed into a tubular shape so as to receive a terminal (male terminal in this embodiment) in the mating connector (not shown), and an inwardly-bent resilient contact piece portion 11*a* for contact with this male terminal is provided within the fitting tubular portion 11. The wire connection portion 12, provided at a rear portion of the terminal adjacent to its central portion, has a U-shaped cross-section, and is open to its upper side so as to receive the wire W, and this wire connection portion is formed by bending portions 14L and 14R (forming side plates, respectively) respectively along bending lines a and b on the wire connection portion 12 (shown in FIG. 25A) after the blanking operation.

When three piercing portions 16*a*, 16*b* and 16*c* (having a ∩-shaped contour or a U-shaped contour), stamped out of the side plate portions 14L and 14R (shown in FIG. 25A) and a bottom plate portion 15, are bent along bending lines c, d and e, respectively, these piercing portions are formed upright on the bottom plate 15, and are arranged in a row in the direction of the length, and are disposed generally centrally of the width of the bottom plate 15, as shown in FIG. 25B. As a result of formation of the stamped-out piercing portions 16*a*, 16*b* and 16*c*, stamped-out openings 17*a*, 17*b* and 17*c* are formed alternately through the left and right plates 14L and 14R, and are also formed through the bottom plate 15.

As shown in the drawings, each of the stamped-out openings 17*a*, 17*b* and 17*c* extends from a widthwise-central portion of the side plate 14L, 14R via the bending line a, b to the widthwise-central portion of the bottom plate 15, and therefore the mechanical strength against an external force, produced when the wire is pulled or bent, is high. The adjacent piercing portions are stamped alternately out of the different (left and right) side plates, respectively, and are raised, and therefore even in the case where the plurality of piercing portions 16*a*, 16*b* and 16*c* are formed upright on the bottom plate 15, and are arranged in the direction of the length of the wire W so as to increase the areas of contact of these piercing portions with the conductor Wa, the left and right side plates 14L and 14R will not much differ in mechanical strength from each other, and therefore will be generally balanced in mechanical strength with each other. Therefore, the plurality of upstanding piercing portions can be formed without any problem while securing the sufficient strength of the wire connection portion 12, and the areas of contact thereof with the conductor of the wire can be increased.

Each of the mountain-shaped piercing portions 16*a*, 16*b* and 16*c*, stamped alternately out of the left and right side plates 14L and 14R, and raised into the upstanding condition, has a tapering apex portion 18, and can penetrate through the insulating sheath Wd of the wire W to pierce the wire W, and each piercing portion, when piercing the wire, intrudes into the bundle of wire elements Wb, Wb, . . . , forming the conductor Wa within the wire W, to contact these wire elements. With respect to this contact, the piercing portions 16*a*, 16*b* and 16*c*, stamped out of the corresponding side plates 14L and 14R and raised, have a flat-plate shape, and are disposed parallel to the direction of the length of the wire, and therefore the area of contact of each piercing portion with the conductor Wa is larger as compared with the conventional construction. An edge of each of the piercing portions 16*a*, 16*b* and 16*c* has such sharpness that it will not cut the wire elements Wb, Wb, . . . upon piercing, and therefore the wire elements will not be severed.

Each of the mountain-shaped piercing portions 16*a*, 16*b* and 16*c* has a foot portion (proximal end portion) 19 of a larger area extending from the bottom plate 15, and because of the provision of this foot portion, the piercing portion will not be brought down upon piercing the wire, and thus the high strength to keep the piercing portion in its upstanding condition is secured. Tapering surfaces 20L and 20R are formed respectively on inner surfaces of the left and right side plates 14L and 14R at the upper portions thereof each extending upwardly from a predetermined portion thereof. These tapering surfaces are provided for the purpose of easily fitting the wire W into the wire connection portion 12.

A pair of press-clamping piece portions 21L and 21R for press-clamping the insulating sheath Wd of the wire W are formed at the press-clamping portion 13, extending rearwardly from the wire connection portion 12, and are offset with respect to each other. When the insulating sheath Wd is press-clamped by this press-clamping portion 13, the wire W will not be easily disengaged from the wire connection portion 12.

Next, an operation for connecting the piercing terminal 10 of this construction to the end portion of the wire W will be described with reference to FIG. 26. FIGS. 26A and 26B are cross-sectional views taken along the line B—B of FIG. 25C, explaining the connection of the wire W to the piercing portion 16*b*. Explanation of the connection of the wire to the other piercing portions 16*a* and 16*c* is the same, and therefore will be omitted.

First, the center of the wire W is disposed in registry with the distal end of the piercing portion 16*b* as shown in FIG. 25A, and in this condition the wire W is pushed into the wire connection portion, and as a result the piercing portion 16*b* pierces the wire W from the lower side thereof, and passes through the upper side of the wire, as shown in FIG. 25B. In the connection by this piercing operation, the cutting of the wire elements is less liable to occur as compared with the connection of the conventional press-contacting terminal in which the conductor is gripped by the press-contacting blades.

Namely, when the piercing portion 16*b* pierces through the wire W, that is, through the conductor Wa within the wire, the piercing portion 16*b* intrudes into the bundle of wire elements Wb, Wb, . . . forming the conductor Wa within the wire. The wire W has the insulating sheath Wd made of a soft resin such as vinyl, and when the piercing portion 16*b* is caused to pierce the conductor Wa within the wire, the wire elements Wb can escape outwardly within the insulating sheath Wd, and therefore the piercing portion is contacted with the wire elements Wb, Wb, . . . in a gripped manner without cutting the wire elements Wb.

After the piercing operation, a load (contact pressure), produced by the contact with the conductor Wa, is exerted at the area 22L, 22R of contact between the outer surface of the piercing portion 16*b* and the surfaces of the wire elements Wb, Wb, . . . , forming the conductor Wa.

Here, in the case where the distance between the left and right side plates 14L and 14R is equal to or slightly smaller than the outer diameter of the wire W so that the wire W can be press-fitted into the gap between the side plates 14L and 14R, that portion of the wire W, held between the inserted piercing portion 16*b* and the side plate 14L, 14R, is compressed, so that the contact pressure at the area 22L, 22R of contact between the piercing portion 16*b* and the conductor Wa can be increased.

There is the case where the distance between the left and right side plates 14L and 14R is slightly larger than the outer diameter of the wire W, and even in this case, if the wire W is bulged laterally to be compressed between the side plates 14L and 14R as a result of deformation of the wire W upon piercing of the piercing portion 16*b*, the pressure of contact between the inserted piercing portion 16*b* and the conductor Wa can be increased. In this case, also, there can be provided the connection structure for producing the sufficient contact load, and besides the piercing portion can be easily caused to pierce the wire.

As shown in FIG. 24, the piercing terminal 10 of the invention can be of such a construction that there are provided three piercing portions. Thus, in the piercing terminal of the invention, the plurality of piercing portions can be formed upright on the bottom plate of the wire connection portion, and can be densely arranged in a row without adversely affecting the mechanical strength of this wire connection portion against the pulling and bending of the wire.

Figure 27:
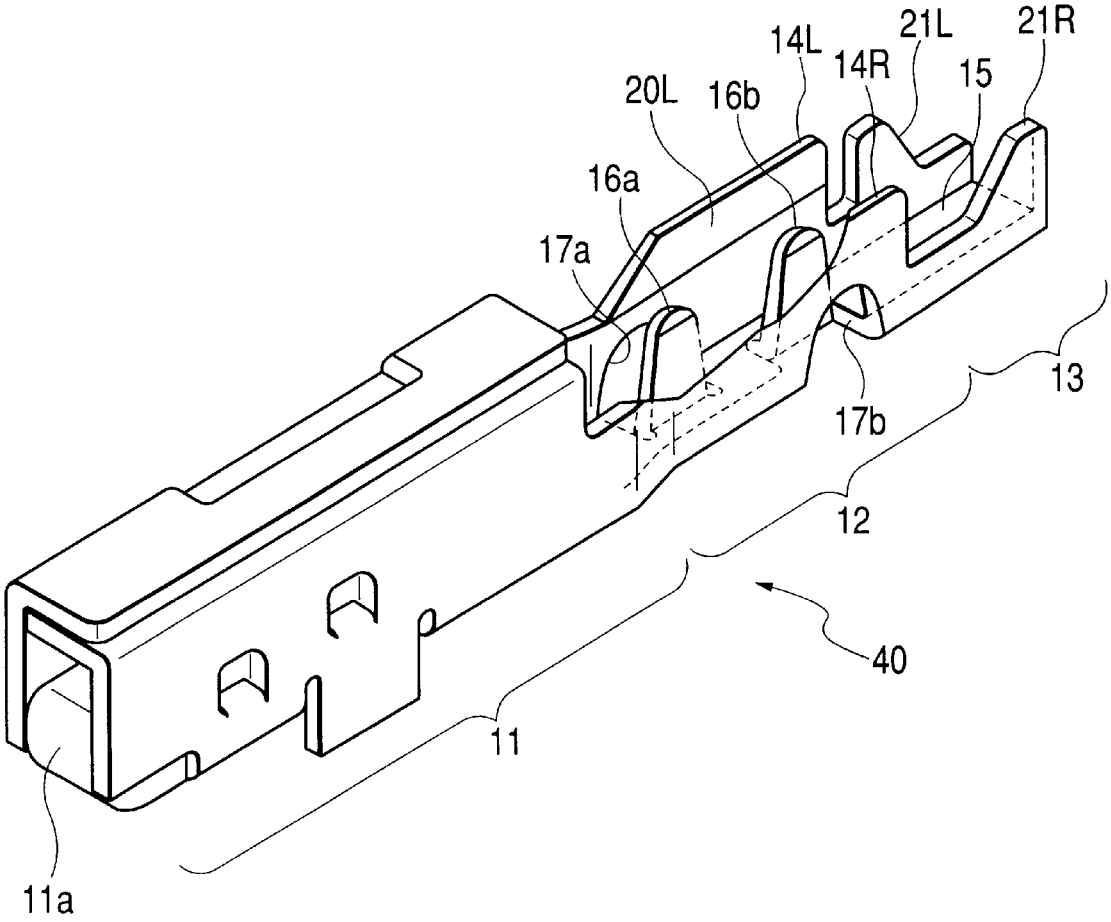
FIG. 27 is a view showing the appearance of another embodiment of a piercing terminal of the invention.

Therefore, in the case where the number of piercing portions is reduced to two as in another embodiment of a piercing terminal 40 of the invention shown in FIG. 27, the length of the terminal can be greatly reduced as shown in this figure without adversely affecting the connection reliability, and this contributes to a compact design of a connector. The piercing terminal 40 of FIG. 27 differs from the above piercing terminal 10 in the number of the piercing portions, and therefore the same construction as described above will be designated by identical reference numerals, and explanation thereof will be omitted.

Although the preferred embodiments of the invention have been described above, the invention is not limited to these embodiments, and other various embodiments can be provided without departing from the scope of the subject matter of the invention. In the above embodiments, although the wire connection portion have two or three piercing portions, the number of such piercing portions may be one or not less than four, and should be determined, depending on the specification (electrical characteristics, mechanical strength and so on) of connection to the wire, and can be suitably changed.

In the above embodiments, although the piercing portions have the mountain-like shape, they are not limited to such a shape, shown in the embodiments, but may have any other suitable shape in so far as such piercing portions can be stamped out of the side plate, and can be raised so as to pierce the wire. In the embodiments, although each of the piercing portions is so arranged as to be disposed in registry with the center of the wire into which the piercing portion pierces, each piercing portion may be so arranged as to be slightly offset with respect to the center of the wire, and can achieve the above-mentioned effects in so far as it can pierce the wire. Further, a barrel portion may be formed on the upper edge of each side plate 14, and this barrel portion is press-deformed after the piercing operation, and by doing so, the contact pressure can be applied more positively, and besides the wire is prevented from upward disengagement after the piercing operation In the invention of aspect 1, the incomplete contact, caused by the cutting of the wire elements when the wire is thin or thick, can be reduced. And besides, the terminal and the wire can be positively connected together with the simple processing without the need for removing the sheath of the wire.

In the invention of aspect 2, the wire connection processing can be effected merely by inserting the wire between the opposite side walls of the terminal without the need for removing the sheath, and the connection processing can be effected utilizing facilities similar to those for the conventional press-contacting terminal. And besides, after the wire is connected, a load is applied to the wire from the opposite side walls to compress the wire, so that the pin contacts the conductor at the proper contact pressure, thereby preventing the wire from being disengaged from the pin.

In the invention of aspect 3, the plate, formed on the upper edge of the side wall, is bent to cover the upper side of the wire, thereby positively preventing the wire from disengagement from the pin.

In the invention of aspect 4, the plate is bent to cover the upper side of the wire, and further the distal end portion of the pin is passed through the hole, and by doing so, the wire can be more positively prevented from disengagement from the pin.

In the invention of aspect 5, the upwardly spread-out side walls or the upwardly spread-out plates serve as the receiving port for receiving the wire, and prevent the misregistration of the wire at the time of connecting the wire, and therefore the wire can be smoothly inserted between the side walls.

In the invention of aspect 6, the plurality of pins are formed on the bottom wall, and therefore the area of contact between the terminal and the wire increases, thereby enhancing the contact reliability, and besides the wire is prevented from disengagement from the pins.

In the invention of aspect 7, the wire is fixed by bending the distal end portion of the pin, and therefore the wire is positively prevented from disengagement from the pin.

In the invention of aspect 8, the pin is joined to the base material of the terminal, for example, by laser welding or the like, and therefore the pin, made of a material having desired strength, electrical resistance and so on, can be formed in a desired position on the bottom wall, and the terminal of high quality can be produced.

In the invention of aspect 9, the pin is formed by stamping the relevant portion out of the base material of the terminal and then by raising it, and therefore the pin can be formed by the method similar to a method of forming a press-contacting blade of a conventional press-contacting terminal, and the facilities for producing the conventional press-contacting terminals can be utilized, and therefore the terminals can be produced at low costs.

Further, in the piercing terminal of the present invention, when each of the piercing portions, formed upright on the bottom plate of the wire connection portion for receiving the end portion of the wire, is caused to pierce the wire from the lower side thereof for connection purposes, the piercing portion is brought into contact with the conductor within the wire, and with this construction the wire elements, forming the conductor, will not be cut, thus eliminating the possibility of the incomplete connection, and the good connection reliability for vibrations and a heat cycle can be obtained.

And besides, there is adopted the construction in which each of the piercing portion is stamped out of the side plate, and is raised. Therefore, even in the case where the wire connection portion is narrowed so as to receive the wire of a small diameter, the piercing portions can be formed upright on the bottom plate while securing the mechanical strength of the wire connection portion against an external force such as a bending force, and besides the degree of freedom of the design is high. Furthermore, in the case where the plurality of upstanding piercing portions are formed, depending on the specification of connection, the length of the wire connection portion can be made shorter as compared with the convention construction, and this contributes to a compact design of a connector containing such terminals.

What is claimed is:

1. A piercing terminal for connection to an end portion of a wire including a conductor, comprising:

a plurality of wire elements twisted together into said conductor, and an insulating covering material covering an outer periphery of said conductor; wherein a wire connection portion of a generally U-shaped cross-section for receiving said end portion of said wire is formed by an electrically-conductive sheet; and a piercing portion, which pierces said insulating covering material of said wire to contact said conductor within said wire, is formed to extend upright from a bottom plate of said wire connection portion, said piercing portion being formed by stamping a relevant portion out of at least one of a left and a right side plates of said wire connection portion and by raising said stamped-out portion, and said wire is received and held between said left and right side plates in a compressed manner, and a dimension between said left and right side plates is slightly smaller than an outer diameter of said wire so that a load is applied to said wire from said left and right side plates to compress said wire.

2. The piercing terminal according to claim 1, wherein a plurality of said piercing portions are formed upright on said bottom plate, and are arranged in a row in a direction of a length of the wire, and said adjacent piercing portions are stamped out of said left and right side plates, respectively, to be raised.

3. The piercing terminal according to claim 1, wherein said piercing portion, formed upright on said bottom plate, is generally in a form of a flat plate, and is disposed parallel to a direction of the length of said wire.

4. The piercing terminal according to claim 3, wherein said piercing portion generally in a form of said flat plate is formed on said bottom wall to be a mountain-like shape.

* * * * *